US007515867B2

(12) United States Patent
Yano

(10) Patent No.: US 7,515,867 B2
(45) Date of Patent: Apr. 7, 2009

(54) IMAGE FORMATION APPARATUS AND SHEET CONVEYANCE APPARATUS

(75) Inventor: Hidetoshi Yano, Toukai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 410 days.

(21) Appl. No.: 11/288,266

(22) Filed: Nov. 29, 2005

(65) Prior Publication Data

US 2006/0140694 A1 Jun. 29, 2006

(30) Foreign Application Priority Data

Nov. 30, 2004 (JP) ..... 2004-347643
Dec. 28, 2004 (JP) ..... 2004-381088

(51) Int. Cl.
*B65H 7/04* (2006.01)
*B65H 3/32* (2006.01)
*B65H 3/50* (2006.01)

(52) U.S. Cl. ..... 399/393; 399/388

(58) Field of Classification Search ..... 399/393, 399/388
See application file for complete search history.

(56) References Cited

U.S. PATENT DOCUMENTS 4,921,363 A * 5/1990 Nishihara et al. ..... 400/120.16
5,228,673 A * 7/1993 Osonoe ..... 271/10.01
5,582,399 A * 12/1996 Sugiura ..... 271/10.11
5,644,663 A * 7/1997 Saito et al. ..... 382/313
5,963,754 A * 10/1999 Itoh et al. ..... 399/21
6,152,443 A * 11/2000 Claramunt et al. ..... 271/258.05
6,374,077 B1 * 4/2002 Hirai et al. ..... 399/407
6,408,147 B1 * 6/2002 Oshida ..... 399/82
6,547,238 B2 * 4/2003 Ardery et al. ..... 271/209
6,851,668 B2 * 2/2005 Mui et al. ..... 271/3.17
6,926,272 B2 * 8/2005 Carter et al. ..... 271/258.01
7,188,837 B2 * 3/2007 Bokelman et al. ..... 271/265.01
7,292,820 B2 * 11/2007 Triplett et al. ..... 399/393
2003/0156150 A1 * 8/2003 Hayashi et al. ..... 347/19
2004/0061283 A1 * 4/2004 Hyun ..... 271/265.01
2004/0131378 A1 7/2004 Hattori et al.
2004/0135311 A1 * 7/2004 Chambers et al. ..... 271/265.01

FOREIGN PATENT DOCUMENTS

JP 62211250 A * 9/1987
JP 62280136 A * 12/1987
JP 01098542 A * 4/1989
JP 04109747 A * 4/1992

(Continued)

*Primary Examiner*—Ren Yan
*Assistant Examiner*—Jung H Nam
(74) *Attorney, Agent, or Firm*—Oliff & Berridge, PLC

(57) ABSTRACT

A sheet conveyance apparatus, includes: a paper feed cassette which is detachably attached to an apparatus body; a conveyance unit which separates and conveys a sheet from the paper feed cassette; a swing member which is swingably supported about a shaft relative to the apparatus body, and whose swing positions are respectively changed in a state where the paper feed cassette is detached from the apparatus body, a state where the paper feed cassette is attached to the apparatus body and where the sheet is not being conveyed, and a state where the paper feed cassette is attached to the apparatus body and where the sheet is not being conveyed; and a detection unit which detects a change of the swing positions.

12 Claims, 20 Drawing Sheets

FOREIGN PATENT DOCUMENTS

| | | | | |
|---|---|---|---|---|
| JP | 05238602 | A | * | 9/1993 |
| JP | A 06-62181 | | | 3/1994 |
| JP | A 06-144642 | | | 5/1994 |
| JP | 11065185 | A | * | 3/1999 |
| JP | A 2000-203734 | | | 7/2000 |
| JP | 2000272808 | A | * | 10/2000 |
| JP | 2001002286 | A | * | 1/2001 |
| JP | 2001063851 | A | * | 3/2001 |
| JP | 2001122450 | A | * | 5/2001 |
| JP | A 2001-206566 | | | 7/2001 |
| JP | 2001348139 | A | * | 12/2001 |
| JP | 2002-154695 | | * | 5/2002 |
| JP | 2002154695 | A | * | 5/2002 |
| JP | A 2002-255373 | | | 9/2002 |
| JP | 2002321857 | A | * | 11/2002 |
| JP | A 2002-370346 | | | 12/2002 |
| JP | A 2003-89437 | | | 3/2003 |
| JP | A 2003-284440 | | | 10/2003 |
| JP | A 2004-157463 | | | 6/2004 |
| JP | 2006008271 | A | * | 1/2006 |

* cited by examiner

IMAGE FORMATION APPARATUS AND SHEET CONVEYANCE APPARATUS

The present disclosure relates to the subject matters contained in Japanese Patent Application No. 2004-381088 filed Dec. 28, 2004 and Japanese Patent Application No. 2004-347643 filed Nov. 30, 2004, which are incorporated herein by reference in their entirety.

TECHNICAL FIELD

One aspect of the present invention relates to a sheet conveyance apparatus, and an image formation apparatus.

BACKGROUND

Heretofore, as a sheet conveyance apparatus, there has been extensively known one which includes a paper feed cassette for placing sheets of paper thereon, and rollers for conveying the sheets of paper one by one (See JP-A-2001-206566.).

This device includes in addition to the above configuration, a sheet end sensing sensor which is constructed of a photosensor and an actuator in order to determine the timing (conveyance interval) of the sheet conveyance, and a sensing switch which is disposed in order to detect the presence or absence of the paper feed cassette.

With the above configuration, each of the conveyance of the sheet and the presence or absence of the paper feed cassette is detected by the dedicated detection means. Since the number of components enlarges in such a configuration, the assemblage of the components becomes complicated to the corresponding extent, and curtailment in the cost and reduction in the size of the device are hampered.

Incidentally, an image formation apparatus is formed with an opening in the side surface of an apparatus body case, and it accommodates a paper feed cassette in which sheets of paper are stacked, in a manner to be capable of pulling out the paper feed cassette through the opening. In an image formation operation, the sheets of paper in the paper feed cassette are fed to a sheet conveyance path one by one by means of a paper feed roller inside the apparatus body case, and the sheet is formed with an image by an image formation section and is ejected into a paper ejection tray through a fixation unit while being conveyed by conveyance rollers.

Meanwhile, in the image formation apparatus of this type, a gap needs to be provided between the opening of the apparatus body case and the paper feed cassette for the purpose of attaining the smooth attachment/detachment of the paper feed cassette. Accordingly, noise made when the sheet being conveyed rubs in the sheet conveyance path or when it rubs with the various rollers, noise made when the sheets of paper are frictionally separated one by one, and the like noise (hereinbelow, termed "rustlings") are prone to come out from the gap.

Besides, some image formation apparatuses employ a so-called "letter-S path scheme" wherein, as disclosed in JP-A-2004-157463 below, the sheet is reversely conveyed so as to be folded back, near that front side of the apparatus on which the attachment/detachment manipulation of the paper feed cassette is performed. The scheme has the problem that especially the rustlings in the reversal conveyance are prone to come out from the gap between the opening and the paper feed cassette.

Here, in order to suppress the rustlings, there is thought out a method wherein an elastic member of sponge or the like is stuck to the apparatus body case or the paper feed cassette at either of parts which vertically oppose to each other through the gap between the opening of the apparatus body case and the paper feed cassette, thereby to cover the gap. The gap, however, is provided in order to smoothen the attachment/detachment of the paper feed cassette. When the gap is shut up by the sponge so as to be vertically covered, there can occur the problems that the elastic member is strongly rubbed every operation of attaching or detaching the paper feed cassette, to be torn off or worn away, so a sealability (noise prevention property) degrades, and that the smooth attachment and detachment of the paper feed cassette are impossible.

SUMMARY

One aspect of the invention has been completed in view of the above circumstances, and it has for its object to provide a sheet conveyance apparatus which is capable of detecting the conveyance of a sheet and detecting the presence or absence of a paper feed cassette, with a small number of components, and an image formation apparatus which includes the sheet conveyance apparatus.

Another aspect of the invention has been completed in view of the above circumstances, and has for its object to provide an image formation apparatus which can restrain rustlings from coming outside, while permitting a paper feed cassette to be smoothly attached/detached.

According to one aspect of the invention a sheet conveyance apparatus, may include: a paper feed cassette which is detachably attached to an apparatus body; a conveyance unit which separates and conveys a sheet from the paper feed cassette; a swing member which is swingably supported about a shaft relative to the apparatus body, and whose swing positions are respectively changed in a state where the paper feed cassette is detached from the apparatus body, a state where the paper feed cassette is attached to the apparatus body and where the sheet is not being conveyed, and a state where the paper feed cassette is attached to the apparatus body and where the sheet is being conveyed; and a detection unit which detects a change of the swing positions.

According to another aspect of the invention, an image formation apparatus may include: an apparatus body having a shaft; and a sheet conveyance apparatus; wherein the sheet conveyance apparatus includes: a paper feed cassette which is detachably attached to the apparatus body; a conveyance unit which separates and conveys a sheet from the paper feed cassette; a swing member which is swingably supported about the shaft relative to the apparatus body, and whose swing positions are respectively changed in a state where the paper feed cassette is detached from the apparatus body, a state where the paper feed cassette is attached to the apparatus body and where the sheet is not being conveyed, and a state where the paper feed cassette is attached to the apparatus body and where the sheet is being conveyed; and a detection unit which detects a change of the swing positions.

According to another aspect of the invention, an image formation apparatus, includes: a cassette in which a recording medium is received; and an apparatus body including an opening that is open to an exterior thereof, and a cassette accommodation portion that accommodates the cassette detachably through the opening; wherein the apparatus body has a first surface having an angle relative to a pulling-out direction of the cassette, at a peripheral edge part of the opening; the cassette overlaps at least the first surface of the peripheral edge part of the opening in a state when the cassette is accommodated in the cassette accommodation portion; the cassette includes a cover wall having a second surface to oppose to the first surface; and at least one of the first surface and the second surface is provided with an elastic member which is held between the first surface and the second surface when the cassette is accommodated in the cassette accommodation portion.

BRIEF DESCRIPTION OF THE DRAWINGS

The present invention may be more readily described with reference to the accompanying drawings.

DETAILED DESCRIPTION

One embodiment of the present invention will be described with reference to FIGS. 1-12.

1. General Configuration of This Embodiment

Figure 1:
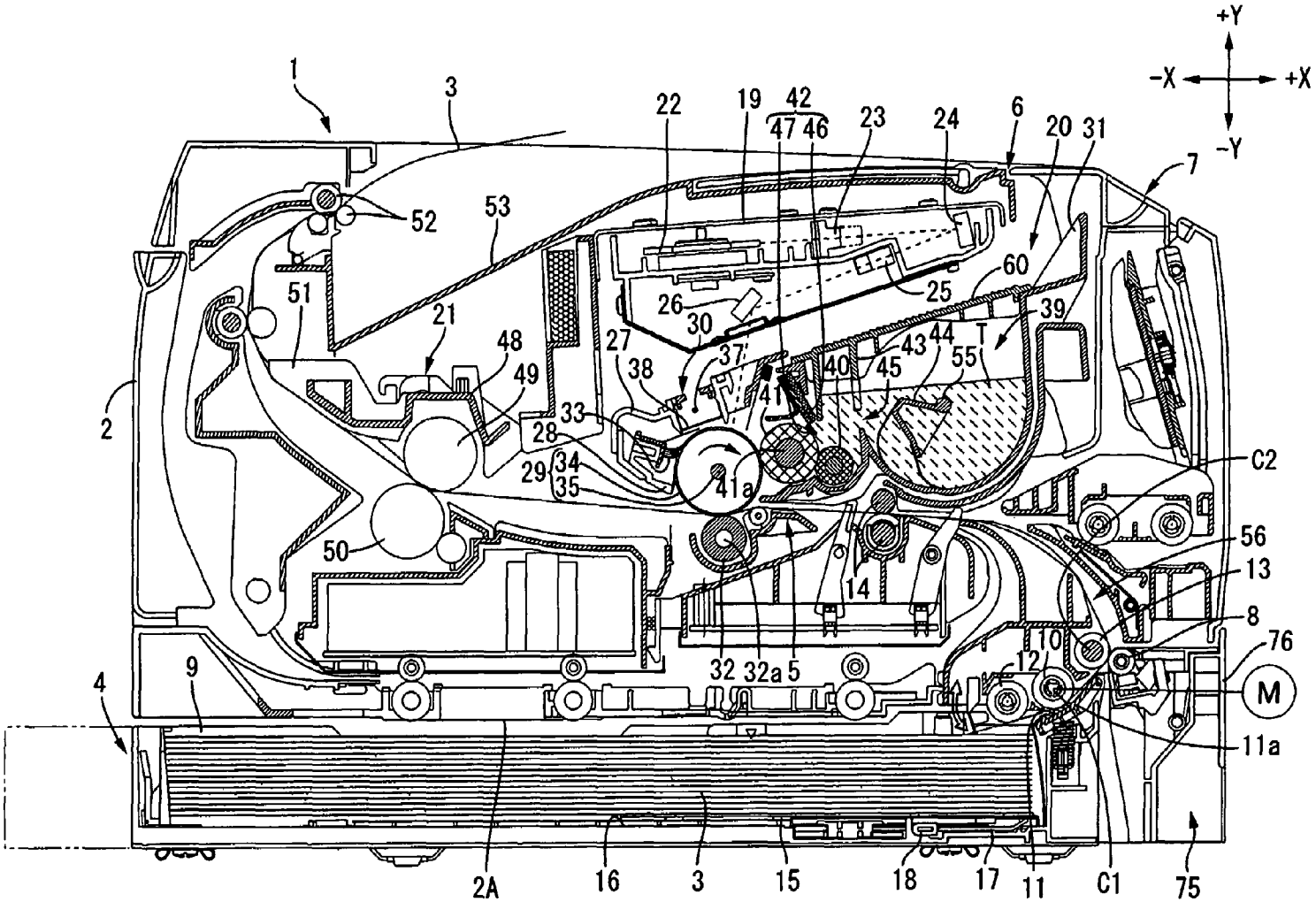
FIG. 1 is a side sectional view of essential portions showing a laser printer according to one embodiment of the present invention.
Figure 2:
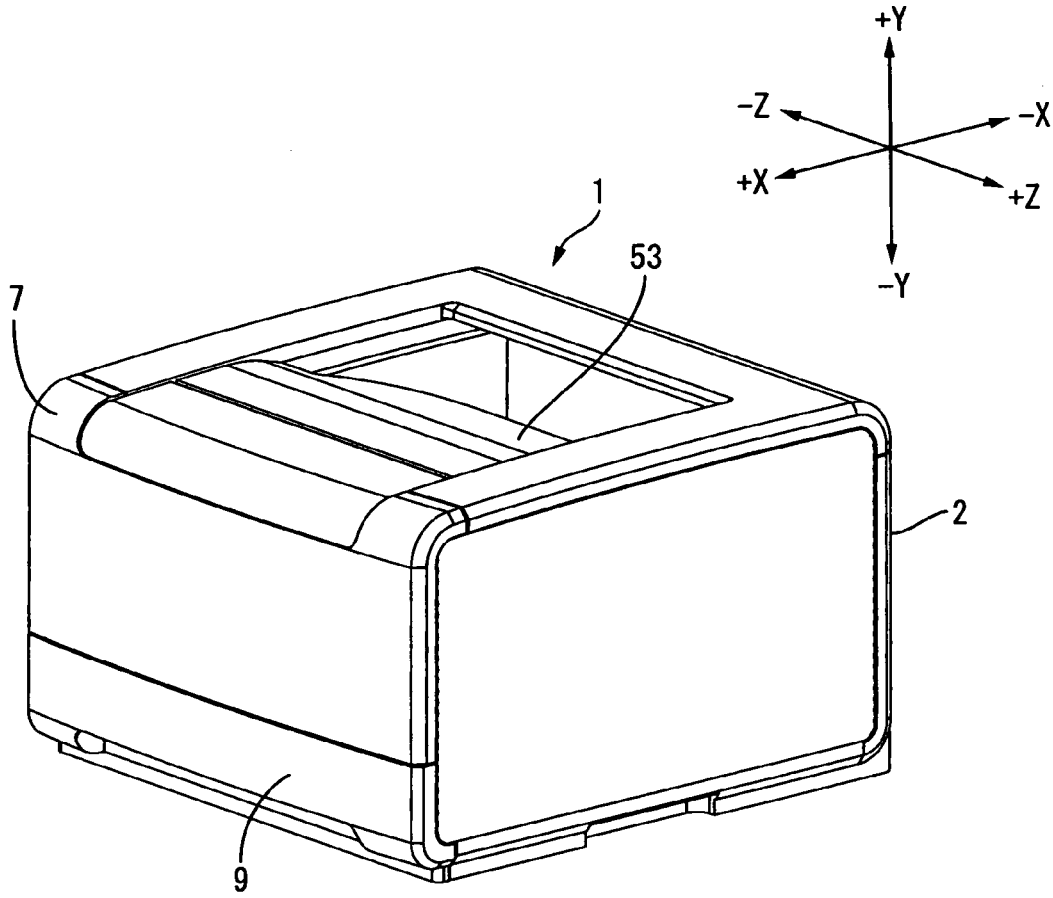
FIG. 2 is a perspective view of the laser printer.
Figure 3:
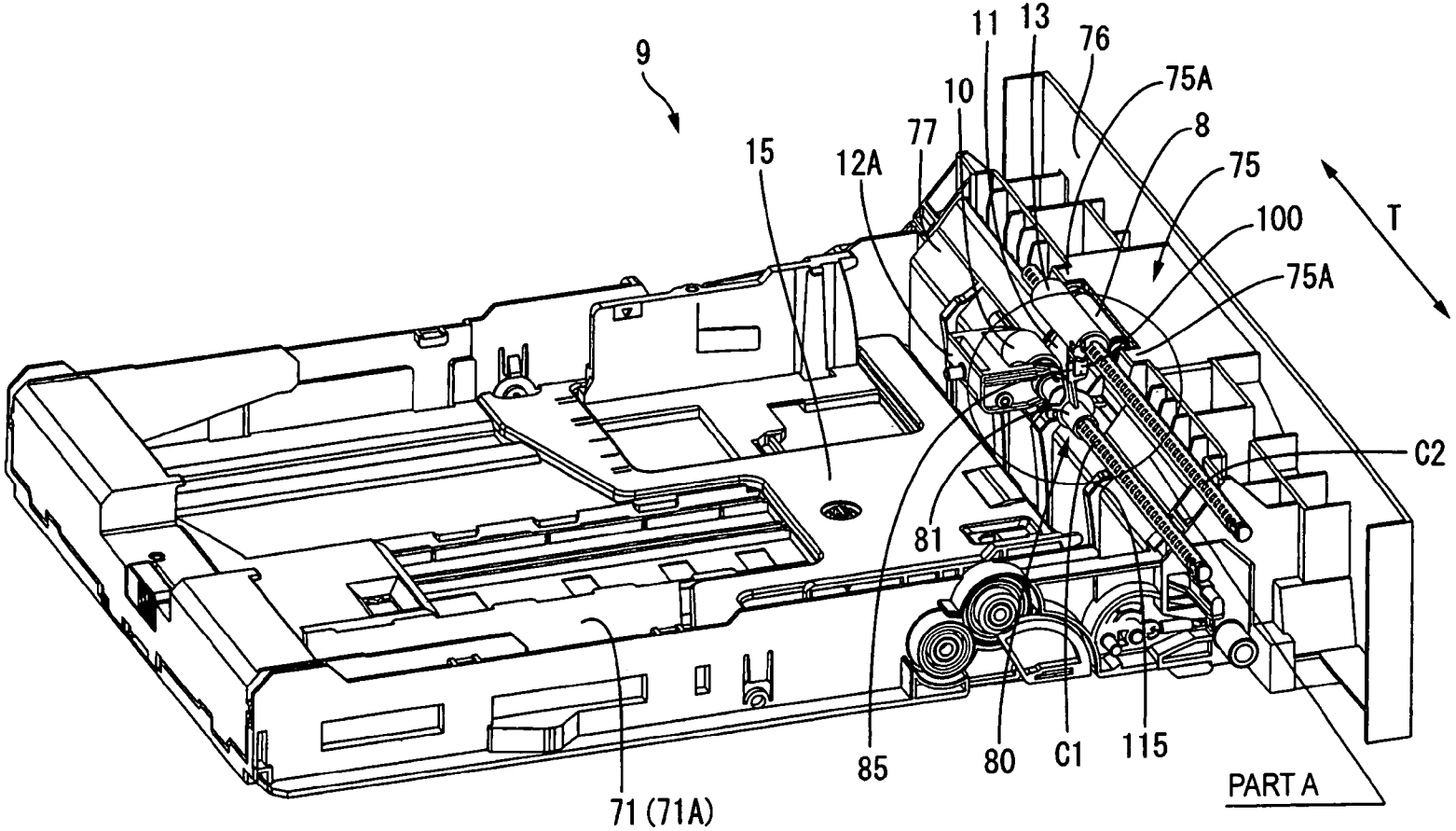
FIG. 3 is a perspective view of a paper feed cassette.
Figure 4:
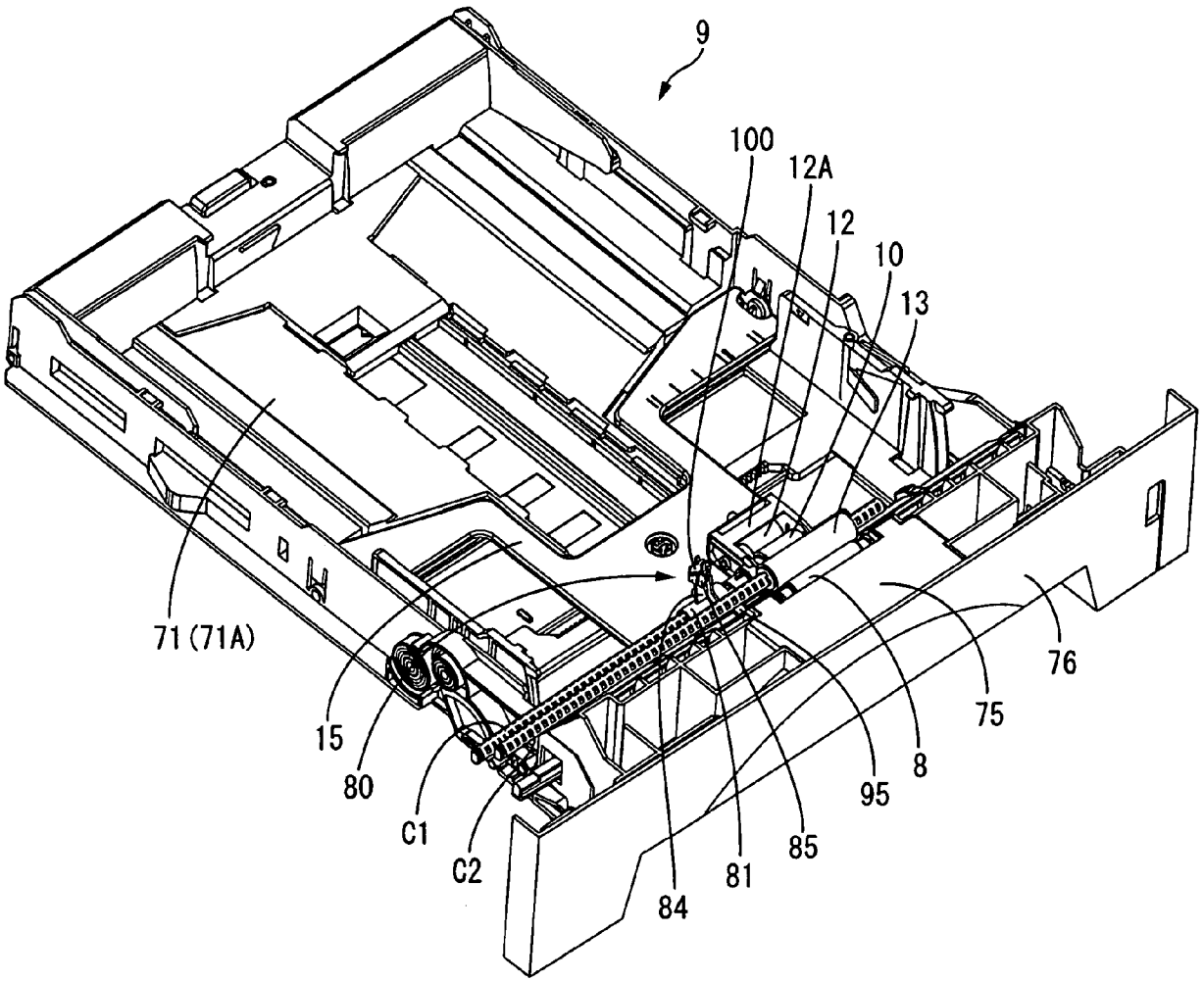
FIG. 4 is also a perspective view of the paper feed cassette.

FIG. 1 is a side sectional view of essential portions showing a laser printer which is the image formation apparatus of the invention. FIG. 2 is a perspective view of the laser printer, and FIGS. 3 and 4 are perspective views of a paper feed cassette. By the way, in the ensuing description, the depthwise direction of the laser printer shall be indicated as the "X-direction" (the front side of the laser printer is set as +X), the widthwise direction thereof as the "Z-direction" (the right side of the laser printer as seen in FIG. 2 is set as +Z), and the heightwise direction thereof as the "Y-direction" (the upper side of the laser printer as seen in FIG. 2 is set as +Y).

The laser printer 1 includes a body casing 2, a feeder section 4 which serves to feed each sheet 3 being a medium to-be-recorded, an image formation section 5 which serves to form an image on the fed sheet 3, and so forth.

(1) Body Casing

An attachment/detachment port 6 for attaching/detaching a process cartridge 20 to be stated later is formed in the sidewall of the body casing (corresponding to the "apparatus body" in the invention) 2 on one side thereof. As shown in FIGS. 1 and 2, a front cover 7 for opening or closing the attachment/detachment port 6 is disposed. The front cover 7 is turnably supported on a cover shaft (not shown) which is inserted through the lower end part thereof.

Thus, when the front cover 7 is closed about the cover shaft, the attachment/detachment port 6 is closed by this front cover 7 as shown in FIG. 1, and when the front cover 7 is opened (inclined) with the cover shaft as a fulcrum, the attachment/detachment port 6 is opened, and the process cartridge 20 can be attached to or detached from the body casing 2 through the attachment/detachment port 6.

Besides, a cassette accommodation portion 2A which is open frontward is provided at the bottom part of the body casing 2. A paper feed cassette 9 to be stated below can be accommodated into the cassette accommodation portion 2A by a manipulation from the front (right side in FIG. 1), or the paper feed cassette 9 accommodated therein can be detached.

(2) Feeder Section

The feeder section 4 is chiefly constructed of the paper feed cassette 9, and rollers for delivering the sheets of paper 3 to a sheet conveyance path 56 one by one. As shown in FIG. 3, the paper feed cassette 9 consists of a cassette body 71 which is in the shape of a shallow tray and in which the sheets of paper 3 are placed in stacked fashion, and a wall portion 75 which is disposed at the front part of the cassette body 71. A sheet presser plate 15 is mounted on the front part of the bottom wall 71A of the cassette body 71. The sheet presser plate 15 has its left-side end in FIG. 3 fixed to the bottom wall 71A, whereas it is not fixed at its end on the opposite side, so that it can bend or flex up and down.

A lever 17 is disposed between the distal end part of the sheet presser plate 15 and the bottom wall 71A of the paper feed cassette 9 (refer to FIG. 1). The lever 17 is adapted to turn about a lever shaft 18. When a turning drive force which is counterclockwise as seen in the figure is inputted to the lever shaft 18, the lever 17 turns with this lever shaft 18 as a fulcrum. Thus, the front end part of the lever 17 lifts up the front end of the sheet presser plate 15, in turn, the sheets of paper 3 stacked in the paper feed cassette 9, thereby to bring the sheet 3 into abutment on a paper feed roller 12 to be stated later.

The wall portion 75 includes a flat front plate 76, and its wall surface opposite to the front plate 76 is formed into an inclined surface 77 which declines toward the side of the cassette body 71. A paper-powder removal roller 8 and a separation pad 11 are respectively arranged above and below at the widthwise central part of the inclined surface 77, and guide pieces 115 are disposed on the inclined surface 77 so as to protrude inward of the cassette 9 (leftward in FIG. 3). The guide pieces 115 are disposed in the number of five along the widthwise direction of the paper feed cassette 9 (a T-direction indicated in FIG. 3, and the Z-direction of the apparatus body).

Figure 6:
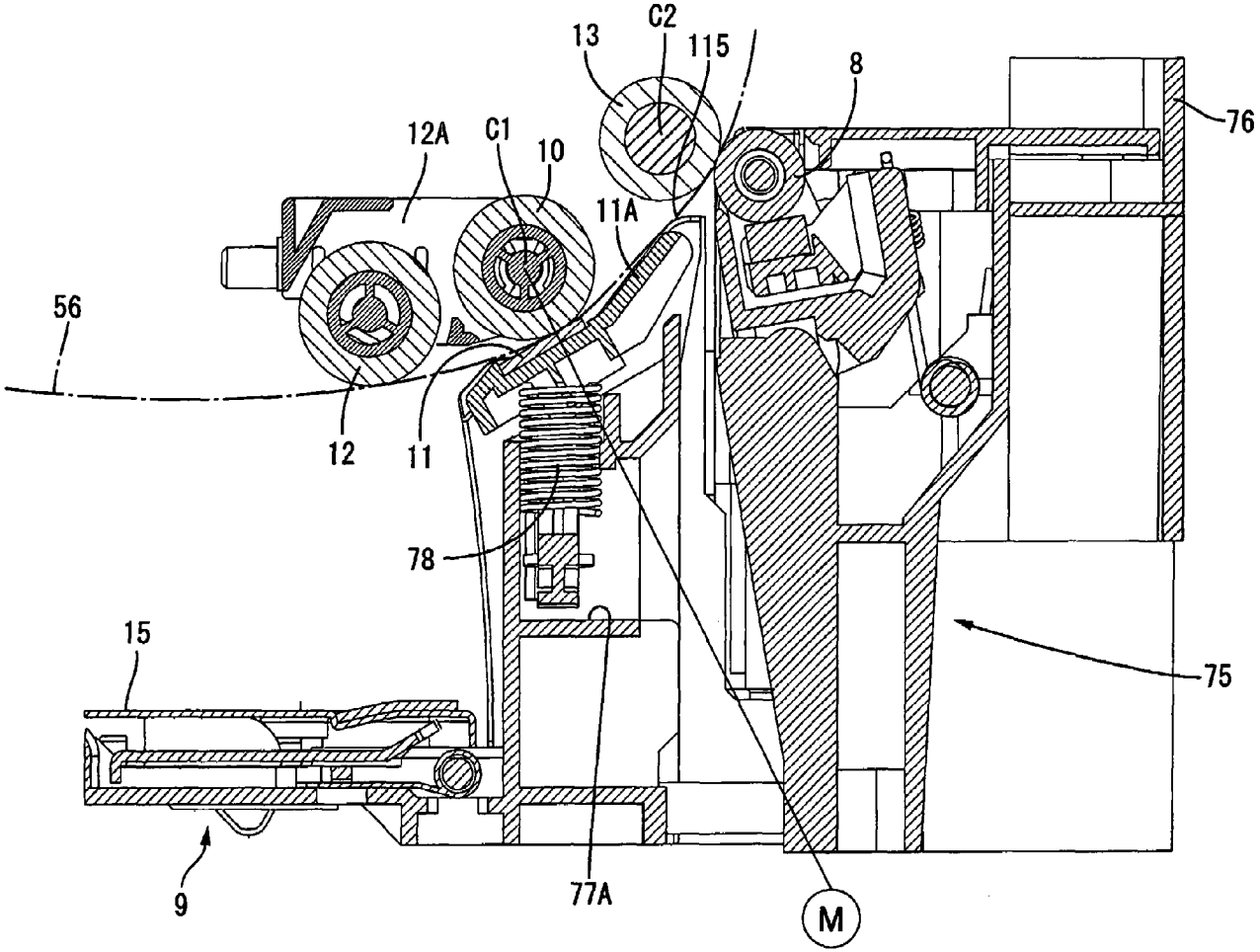
FIG. 6 is a sectional view taken along line VI-VI in FIG. 5.

In a state where the paper-powder removal roller 8 has its axis situated in the widthwise direction of the paper feed cassette 9, both the end parts of the turning shaft of this roller 8 are held by a pair of holding walls 75A formed in the wall portion 75. Besides, as shown in FIG. 6, a recess 77A is formed in that part of the inclined surface 77 of the wall portion 75 which lies below the paper-powder removal roller 8, and a coiled spring 78 which has a pad presser plate 11A fixed to its upper end is vertically accommodated in the recess 77A. The separation pad 11 is stuck on the upper surface of the pad presser plate 11A.

Meanwhile, as shown in FIG. 1, the paper feed roller 12, a separation roller 10 and an opposition roller 13 are successively arranged on the front side of a ceiling wall in the cassette accommodation portion 2A, that is, at positions opposing to the wall portion 75 of the paper feed cassette 9. Here, the support structures of the rollers will be briefly described. As shown in FIG. 3, the center shaft (corresponding to the "shaft" in the invention) C1 of the separation roller 10 and the center shaft C2 of the opposition roller 13 extend in the widthwise direction of the paper feed cassette 9, respectively, and both the end parts of each of the center shafts C1 and C2 are supported by the body casing 2 in a state where the axis of each center shaft is situated in a direction orthogonal to the direction of the conveyance of the sheet. On the other hand, the paper feed roller 12 does not have any center shaft which is connected to the body casing 2 as in the separation roller 10 or the opposition roller 13, and it is held in a turnable state on the center shaft C1 by a substantially U-shaped holder 12A.

Incidentally, both FIGS. 3 and 4 are the perspective views of the paper feed cassette 9, whereas the separation roller 10, opposition roller 13 and paper feed roller 12 are components which are mounted on the body casing 2. Therefore, the separation roller 10 and the opposition roller 13 are the components which ought not to appear in the figures. However, they are daringly illustrated in the figures in order to represent their relations with the paper feed cassette 9 or the roller 8 disposed in this cassette.

Besides, as will be described in detail later, a swing link (corresponding to a "swing member" in the invention) 80 is outserted onto the center shaft C1, in juxtaposition to the separation roller 10. The swing link 80 serves to detect the detachment of the paper feed cassette 9 from the cassette accommodation portion 2A, and to detect the conveyance of the sheet.

As shown in FIG. 1, when the paper feed cassette 9 is accommodated in the cassette accommodation portion 2A, the front plate 76 of the paper feed cassette 9 becomes flush with the front wall of the body casing 2 to close the entrance of the cassette accommodation portion 2A, and the separation roller 10 and the separation pad 11 oppose, while the paper-powder removal roller 8 and the opposition roller 13 oppose.

Thus, the sheet conveyance path 56 is formed by the rollers 8, 10, 12 and 13 and the guide pieces 115 of the wall portion 75. Besides, on this occasion, the urging force of the coiled spring 78 establishes a state where the separation pad 11 is pressed against the separation roller 10. Thus, an appropriate frictional force is exerted between the separation roller 10 and the conveyed sheet, thereby to prevent the sheets of paper 3 from being fed into the sheet conveyance path 56 in a stacked state.

Besides, letter M indicated in FIG. 1 denotes a driving motor. When the motor M is driven, the driving torque of the motor M is transmitted by a power transmission gear not shown, whereby the center shafts C1 and C2, in turn, the rollers 10, 12 and 13 are turned. Further, as shown in FIG. 1, the sheet conveyance path 56 is folded back in the shape of letter U and rearward (leftward as seen in the figure) from the vicinity of the position of the paper-powder removal roller 8, and registration rollers 14 consisting of a pair of rollers are disposed under the process cartridge 20. Thus, the sheet 3 traces the sheet conveyance path 56 and is sent onto the side of the image formation section 5 to be stated below, in accordance with the drive of the motor M.

Incidentally, the motor M has its drive controlled by a control device not shown (which performs the electrical controls of the whole apparatus). In this embodiment, a mechanism in which the supply of electric power to a motor drive circuit is cut off by the detachment of the paper feed cassette 9 is assembled in the body casing 2. In a state where the paper feed cassette 9 has been detached from the cassette accommodation portion 2A, the drive of the motor M is stopped.

Besides, the rollers 8, 12 and 13 functions "conveyance unit" in the invention.

(3) Image Formation Section

The image formation section 5 includes a scanner portion 19, the process cartridge 20, a fixation portion 21, and so forth.

(a) Scanner Portion

The scanner portion 19 is disposed at an upper part inside the body casing 2, and it includes a laser light source not shown, a polygon mirror 22 which is driven to rotate, an fθ lens 23, a reflector 24, a lens 25, a reflector 26, and so forth. As indicated by a broken line, a laser beam emitted from the laser light source and based on image data is deflected by the polygon mirror 22 and is passed through the fθ lens 23. Thereafter, the laser beam has its optical path folded back by the reflector 24 and is further passed through the lens 25. Thereafter, the laser beam has its optical path further crooked downward by the reflector 26. Thus, the laser beam is projected onto the surface of the photosensitive drum 29 of the process cartridge 20 as stated below.

(b) Process Cartridge

The process cartridge 20 is detachably attached to the body casing 2 under the scanner portion 19. This process cartridge 20 includes as its housing, an upper frame 27 and a lower frame 28 which is formed separately from the upper frame 27 and which is combined with the upper frame 27. Besides, the process cartridge 20 includes within the housing, the photosensitive drum 29 being an image carrier, a scolotron type electric charger 30 functioning as a charging unit, a development cartridge 31, a transfer roller 32 functioning as a transfer unit, and a cleaning brush 33.

The photosensitive drum 29 is in a cylindrical shape, and it includes a drum body 34 whose outermost surface layer is formed of a positively-charging photosensitive layer made of polycarbonate or the like, and a metal-made drum shaft 35 being a shaft which extends along the longitudinal direction of the drum body 34 at the axis of this drum body 34. The drum shaft 35 is supported by the upper frame 27, and the drum body 34 is supported so as to be turnable relative to the drum shaft 35, whereby the photosensitive drum 29 is disposed so as to be turnable about the drum shaft 35, in the upper frame 27.

The scolotron type charger 30 is supported by the upper frame 27, and it is arranged in opposition to the photosensitive drum 29 behind and obliquely above the photosensitive drum 29, at a predetermined spacing so as not to touch the photosensitive drum 29. This scolotron type charger 30 includes an electric discharge wire 37 which is arranged in opposition to the photosensitive drum 29 at a predetermined spacing therefrom, and a grid 38 which is disposed between the discharge wire 37 and the photosensitive drum 29 and which serves to control the quantity of discharge from the discharge wire 37 to the photosensitive drum 29. In the scolotron type charger 30, a bias voltage is applied to the grid 38, while at the same time, a high voltage is applied to the discharge wire 37, and the discharge wire 37 is caused to generate a corona discharge, whereby the surface of the photosensitive drum 29 can be uniformly charged in the positive polarity.

The development cartridge 31 includes a box-shaped accommodation case 60 which is open on its rear side, and it is dismountably mounted on the lower frame 28. A toner accommodation chamber 39, a toner supply roller 40, a development roller 41 and a layer-thickness regulation blade 42 are disposed in the development cartridge 31.

The toner accommodation chamber 39 is formed as that front internal space of the accommodation case 60 which is partitioned by a partition plate 43. In the toner accommodation chamber 39, a toner T of single nonmagnetic component which has a positively charging property is packed as a developer. Used as the toner T is a polymerized toner which is obtained in such a way that a polymerizable monomer, for example, a styrenic monomer such as styrene, or an acrylic monomer such as acrylic acid, alkyl (C1-C4) acrylate or alkyl (C1-C4) methacrylate, is copolymerized by suspension polymerization or the like. Such a polymerized toner is substantially globular and exhibits a very good fluidity, so that it can achieve image formation of high image quality.

Incidentally, a coloring agent such as carbon black, a wax, etc. are compounded in such a toner, and an additive such as silica is added thereto in order to enhance the fluidity. The mean grain diameter of the toner is about 6-10 μm.

Besides, an agitator 44 which is supported by a rotary shaft 55 centrally arranged is disposed in the toner accommodation chamber 39. The agitator 44 is driven to rotate by inputting power from a motor not shown. When the agitator 44 is driven to rotate, the toner T in the toner accommodation chamber 39 is stirred, and it is released toward the toner supply roller 40 from an opening 45 which communicates in the front and rear direction of the laser printer 1 under the partition plate 43. Besides, window members (not shown) are mounted on those regions of both the right and left sidewalls of the accommodation case 60 which correspond to the toner accommodation chamber 39, respectively. Each of the window members is cleaned by a wiper which is held by and interlocked with the agitator 44. Incidentally, the body casing 2 is provided with a light emitting element (not shown) outside one window member, and a light receiving element (not shown) outside the other window member. Thus, light is emitted from the light emitting element, sensing light having passed through the interior of the accommodation case 60 is detected by the light receiving element, and the presence or absence of the toner T is discriminated in accordance with the output value of the sensing light.

The toner supply roller 40 is arranged behind the opening 45, and it is rotatably supported by the development cartridge 31. This toner supply roller 40 is constructed in such a way that a metal-made roller shaft is covered with a roller body which is made of an electrically-conductive foamed material.

The development roller 41 is rotatably supported by the development cartridge 31 behind the toner supply roller 40 in a state where it touches the toner supply roller 40 so as to be compressed to each other. Besides, the development roller 41 opposes to and touches the photosensitive drum 29 in a state where the development cartridge 31 is mounted on the lower frame 28.

A roller shaft 41*a* has both its end parts protruded out of the side surfaces of the development cartridge 31 in the widthwise direction (Z-axial direction) of the apparatus body, at the front end part of the development cartridge 31. The development roller 41 including the roller shaft 41*a* is such that the surface of a roller body which is made of electrically-conductive urethane rubber or silicone rubber containing carbon particles or the likes is covered with a coat layer of urethane rubber or silicone rubber containing fluorine. A development bias is applied to the development roller 41 during development. Besides, the development roller 41 is driven to rotate in the same direction as that of the toner supply roller 40 by inputting power from a motor not shown.

The layer-thickness regulation blade 42 includes a blade body 46 which is made of a metallic leaf spring member, and a presser portion 47 of semicircular sectional shape, which is disposed at the distal end part of the blade body 46 and which is made of electrically-insulating silicone rubber. This layer-thickness regulation blade 42 is supported by the development cartridge 31 over the development roller 41, and the presser portion 47 is held in pressed touch with the development roller 41 by the elastic force of the blade body 46.

The toner T released from the opening 45 is supplied onto the development roller 41 by the rotation of the toner supply roller 40. On this occasion, the toner T is frictionally charged in the positive polarity between the toner supply roller 40 and the development roller 41. The toner T supplied onto the development roller 41 advances in between the development roller 41 and the presser portion 47 of the layer-thickness regulation blade 42, with the rotation of the development roller 41, whereby this toner T is carried on the development roller 41 as a thin layer of predetermined thickness.

The transfer roller 32 is rotatably supported by the lower frame 28. In a state where the upper frame 27 and the lower frame 28 are combined, the transfer roller 32 is arranged so as to touch the photosensitive drum 29 in vertical opposition thereto and to form a nip between this transfer roller and the photosensitive drum 29. This transfer roller 32 is constructed in such a way that a metal-made roller shaft 32*a* is covered with a roller body which is made of an electrically-conductive rubber material. A transfer bias is applied to the transfer roller 32 during transfer.

The cleaning brush 33 is mounted on the lower frame 28. In the state where the upper frame 27 and the lower frame 28 are combined, the cleaning brush 33 is arranged so as to oppose to and touch the photosensitive drum 29 behind this photosensitive drum 29.

As the photosensitive drum 29 is rotated, its surface is first uniformly charged in the positive polarity by the scolotron type charger 30. Thereafter, the surface is exposed to light by high-speed scanning with the laser beam from the scanner portion 19, thereby to be formed with an electrostatic latent image which corresponds to an image to be formed on the sheet 3.

Subsequently, owing to the rotation of the development roller 41, when the development roller 41 opposes to and touches the photosensitive drum 29, the toner carried on the development roller 41 and charged positively is supplied to the electrostatic latent image which is formed on the surface of the photosensitive drum 29, in other words, that exposed part of the surface of the photosensitive drum 29 uniformly charged in the positive polarity which has been exposed to the light by the laser beam and whose potential has lowered. Thus, the electrostatic latent image of the photosensitive drum 29 is visualized, and a toner image based on reversal development is carried on the surface of the photosensitive drum 29.

Thereafter, the toner image carried on the surface of the photosensitive drum 29 is transferred onto the sheet 3 by the transfer bias applied to the transfer roller 32, while as shown in FIG. 1, the sheet 3 conveyed in by the registration rollers 14 passes through the transfer position between the photosensitive drum 29 and the transfer roller 32. The sheet 3 onto which the toner image has been transferred, is conveyed to the fixation portion 21.

Incidentally, a transfer remainder toner which remains on the photosensitive drum 29 after the transfer is recovered by the development roller 41. Besides, paper powder from the sheet 3 as adheres onto the photosensitive drum 29 after the transfer is removed by the cleaning brush 33.

(c) Fixation Portion

The fixation portion 21 is disposed behind the process cartridge 20. It includes a fixation frame 48, and a heating roller 49 and a pressing roller 50 which are disposed in the fixation frame 48.

The heating roller 49 includes a metal pipe whose surface is coated with a fluorine resin, and a heating halogen lamp which is disposed in the metal pipe, and it is driven to rotate by inputting power from a motor not shown. On the other hand, the pressing roller 50 is arranged under and in opposition to the heating roller 49 so as to press the heating roller 49. This pressing roller 50 is constructed by covering a metal-made roller shaft with a roller body made of a rubber material, and it is driven in accordance with the rotational drive of the heating roller 49.

In the fixation portion 21, the toner transferred onto the sheet 3 at the transfer position is thermally fixed while the sheet 3 passes between the heating roller 49 and the pressing roller 50. The sheet 3 on which the toner has been fixed, is conveyed to a paper ejection path 51 which extends vertically toward the upper surface of the body casing 2. The sheet 3 conveyed to the paper ejection path 51 is ejected onto a paper ejection tray 53 formed on the upper surface of the body casing 2, by paper ejection rollers 52 which are disposed over the paper ejection path 51.

Figure 5:
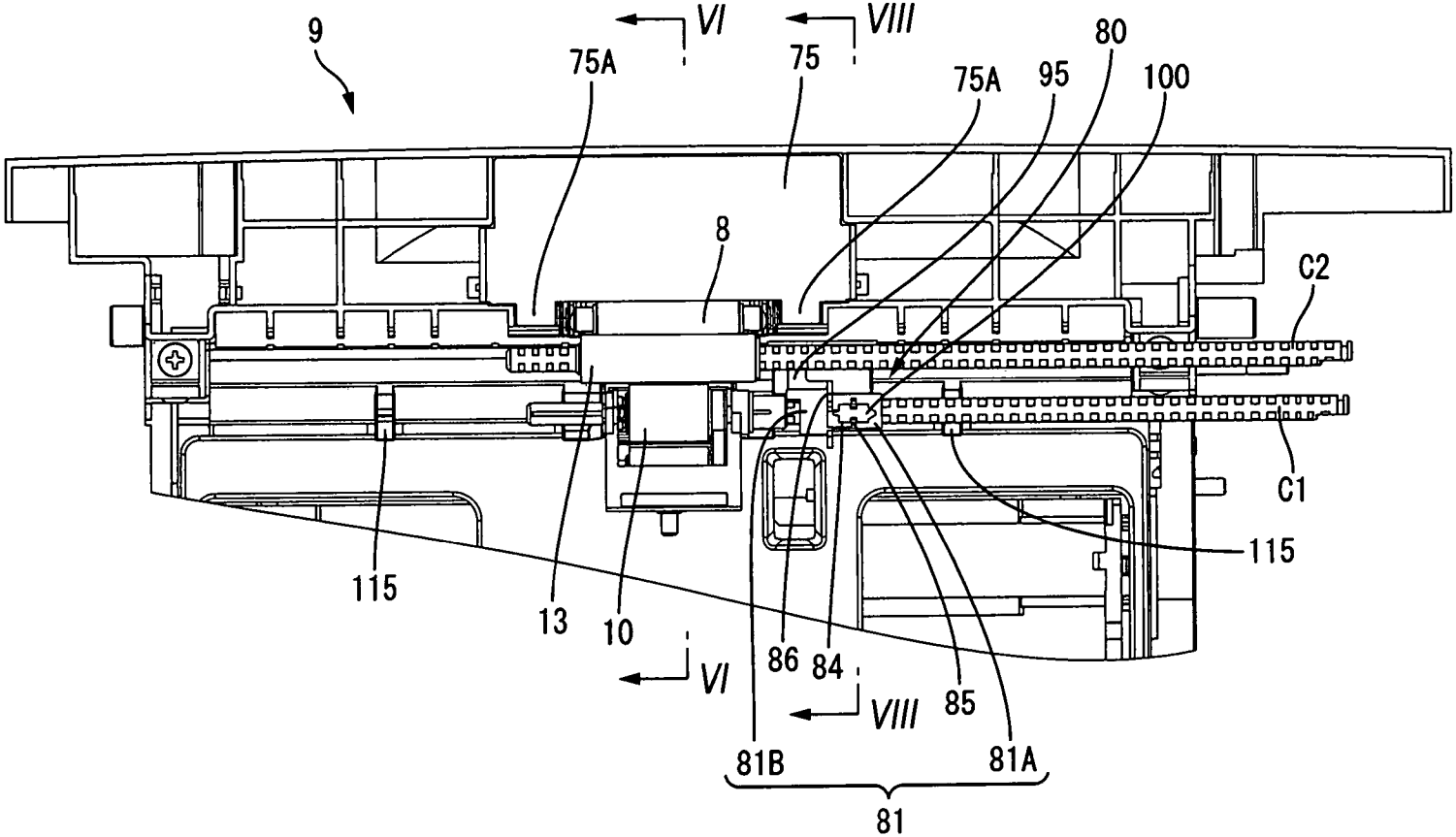
FIG. 5 is a plan view of the paper feed cassette (showing only the front portion side thereof).
Figure 7:
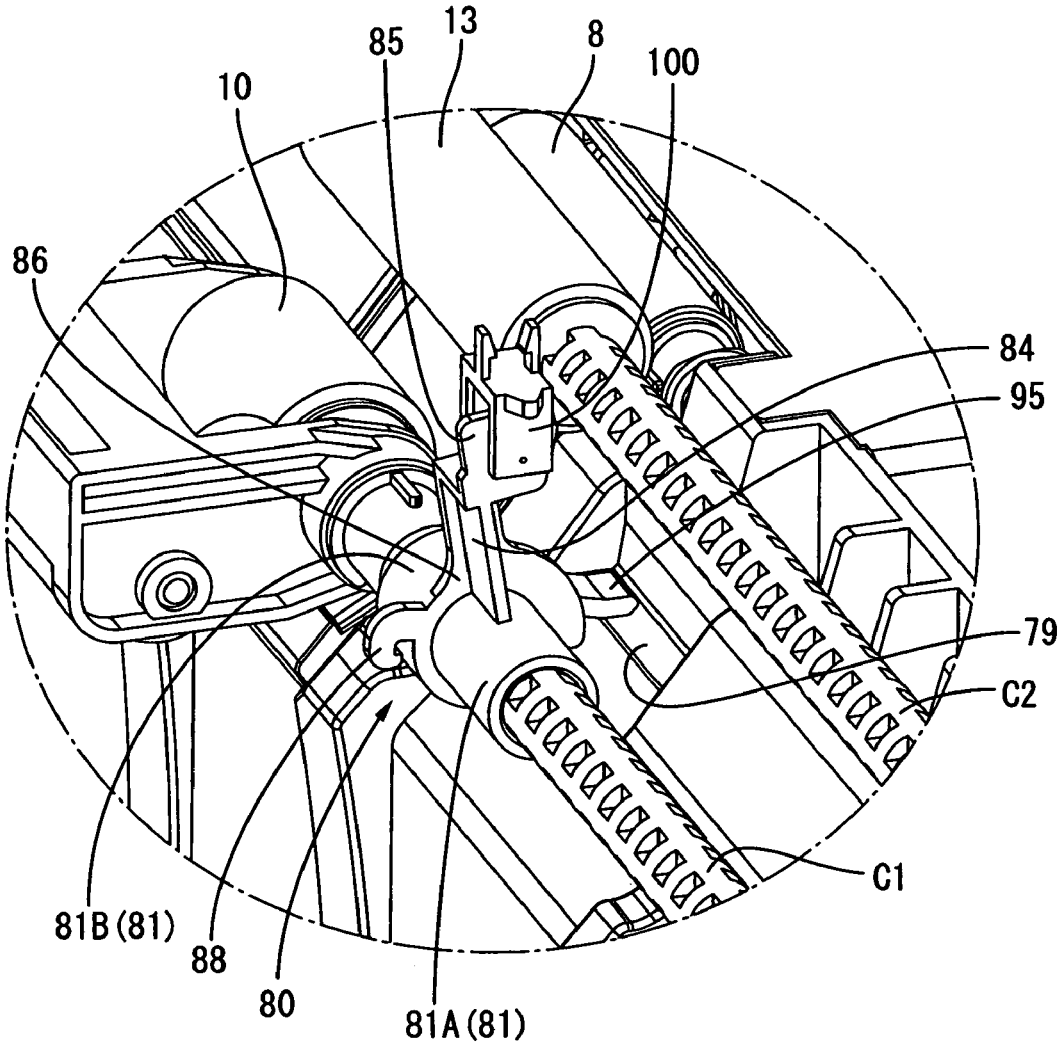
FIG. 7 is an enlarged view of a part A in FIG. 3.
Figure 8:
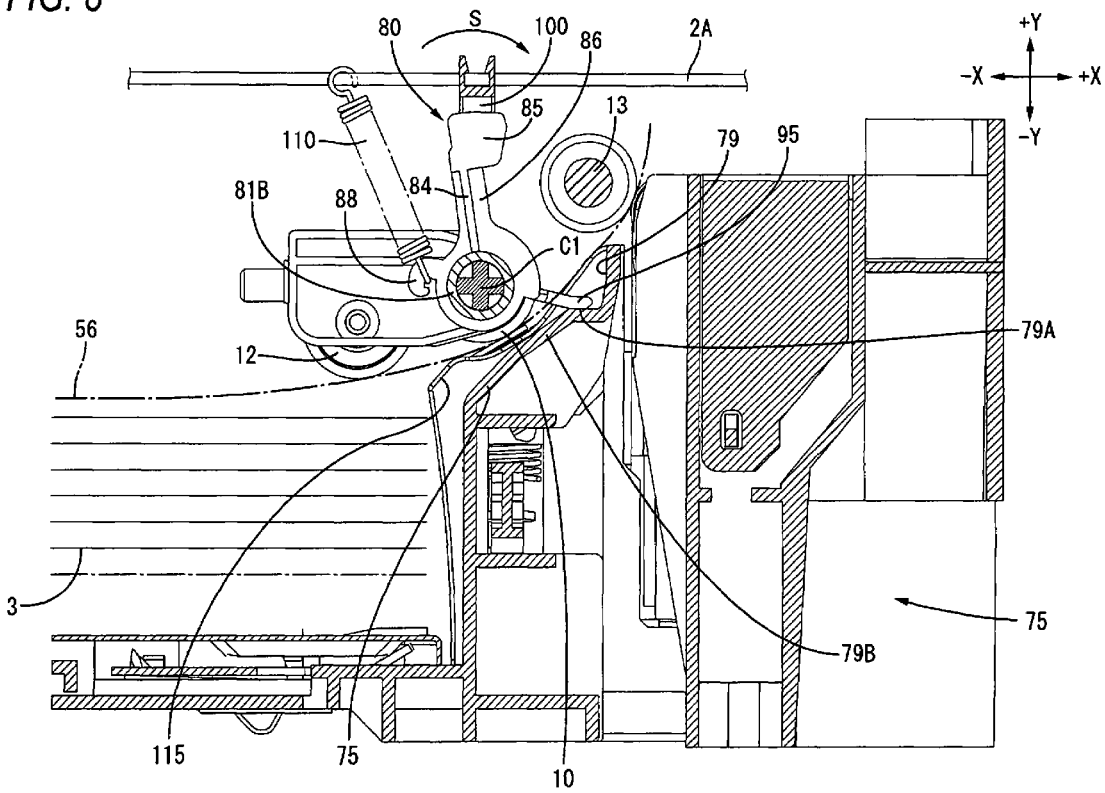
FIG. 8 is a sectional view showing the first attitude of a swing link.
Figure 9:
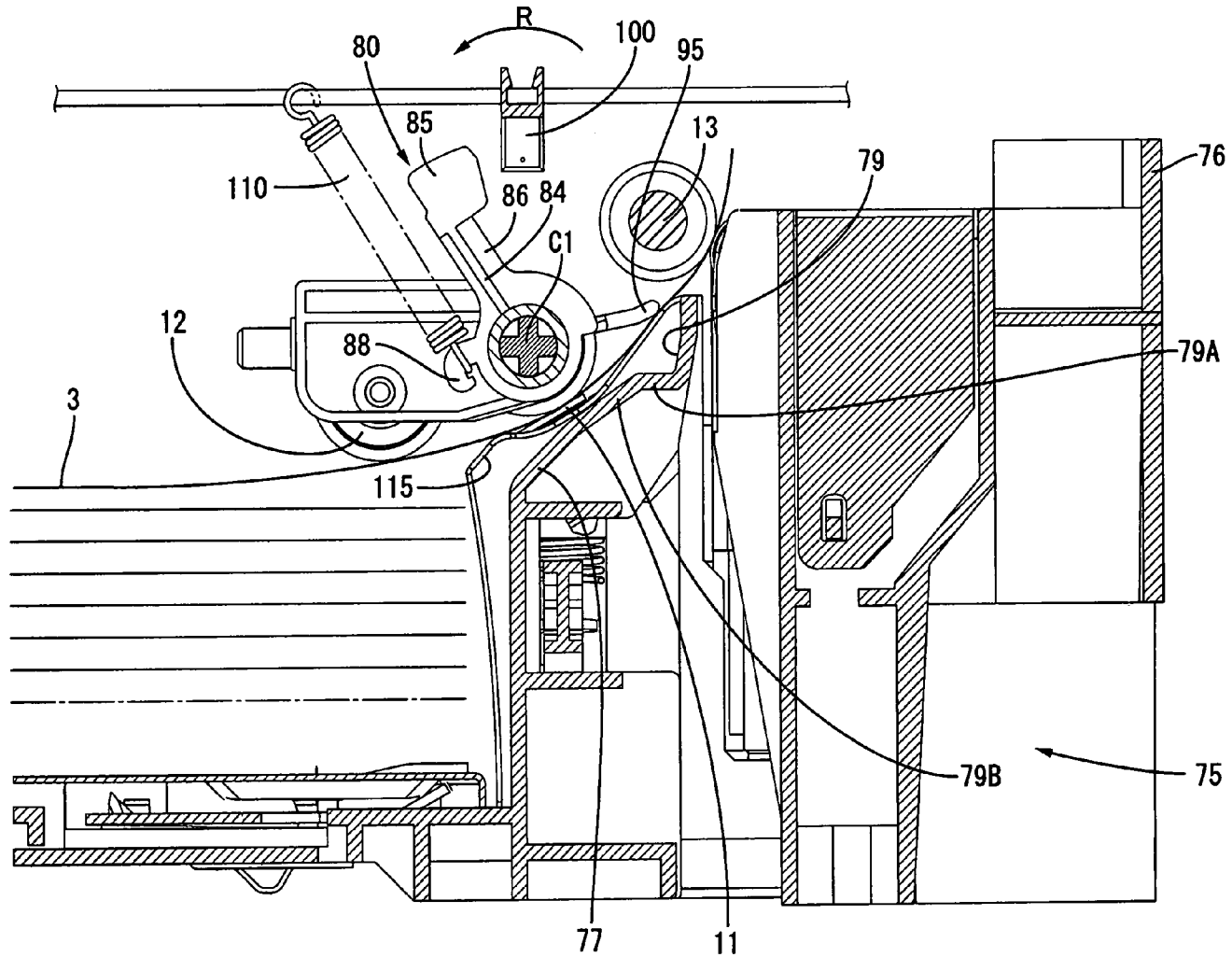
FIG. 9 is a sectional view showing the second attitude of the swing link.
Figure 10:
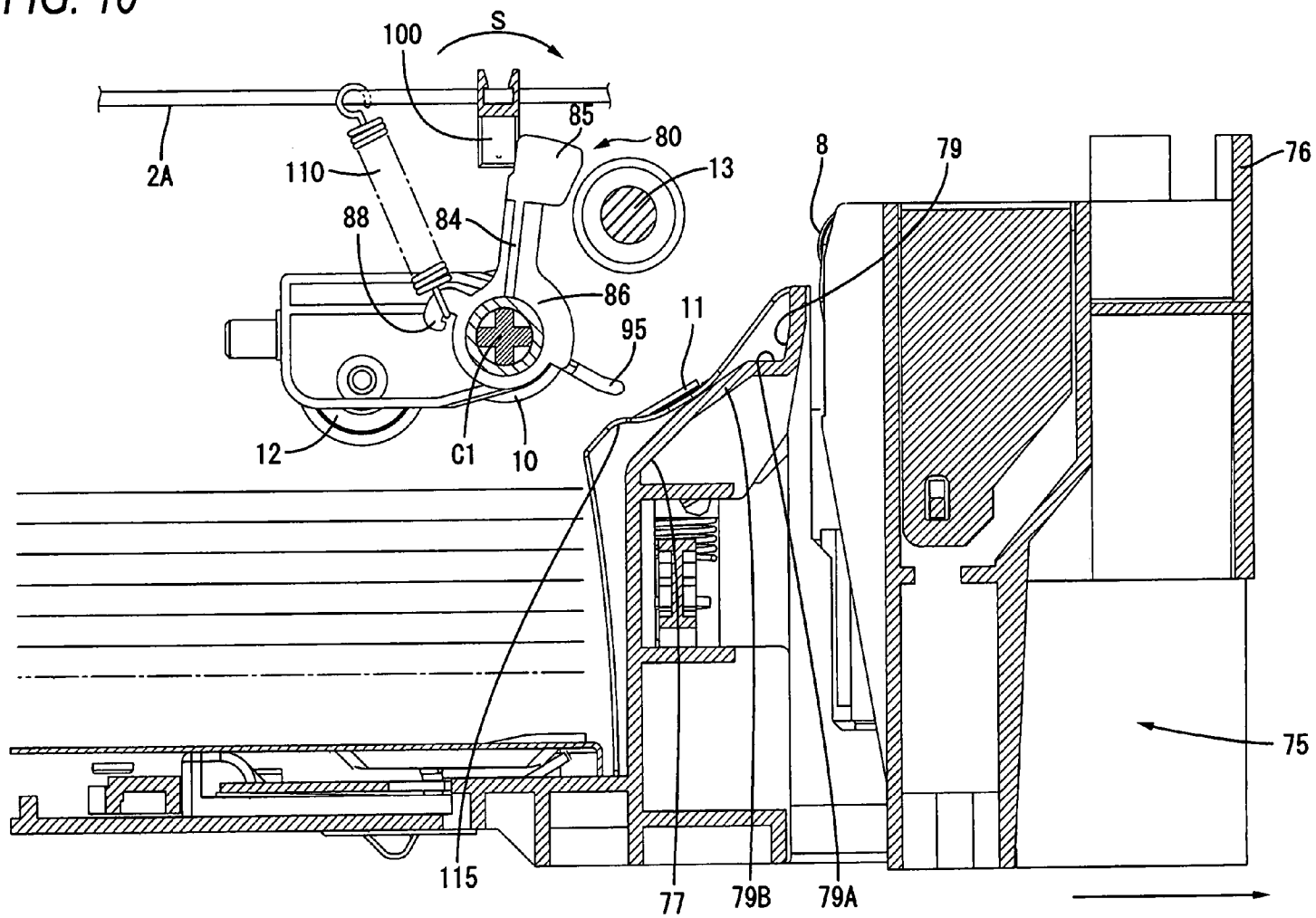
FIG. 10 is a sectional view showing the third attitude of the swing link.
Figure 12:
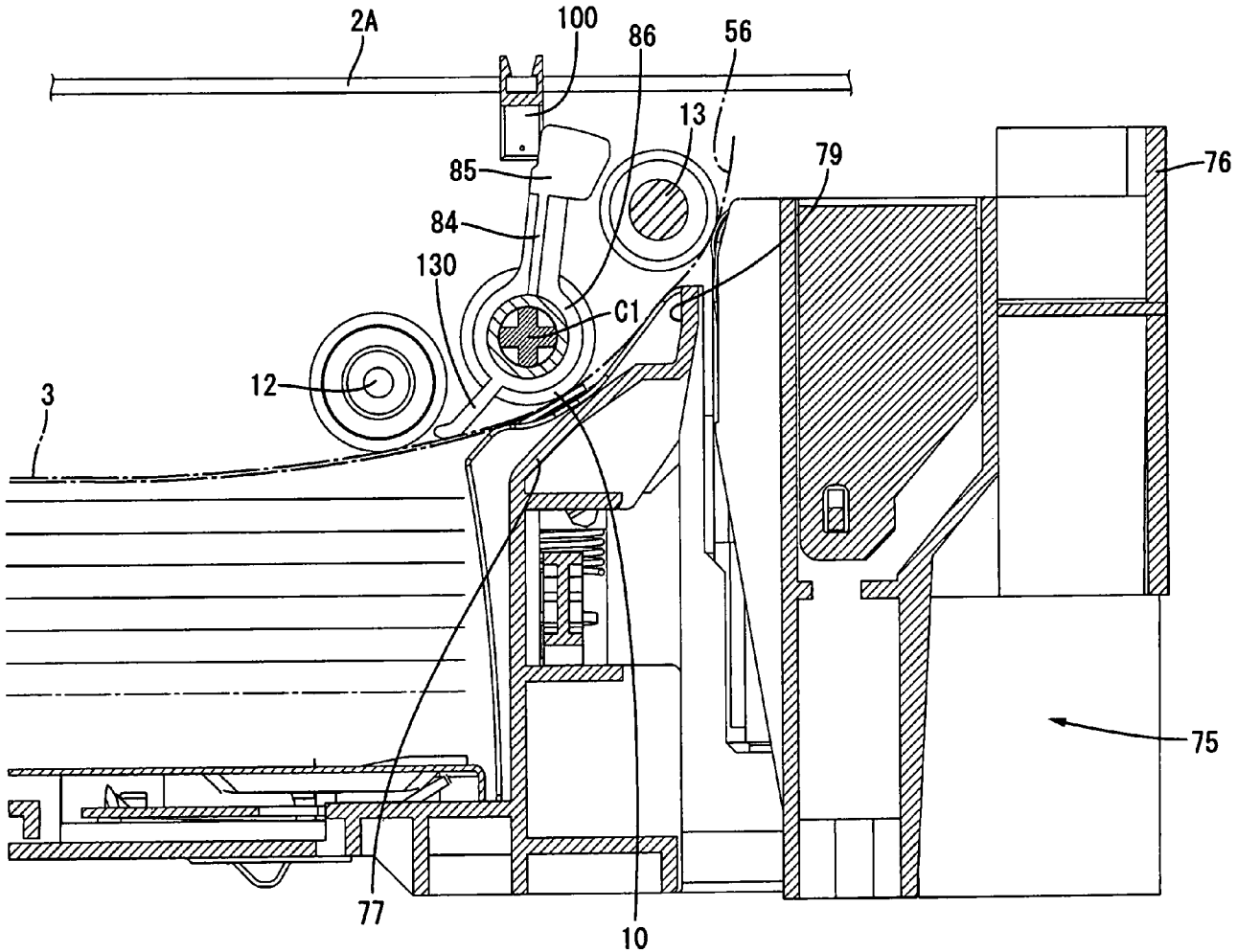
FIG. 12 is a sectional view in the case where a protrusive portion is disposed on the upstream side of a separation roller.

2. Structure for Detection of Attachment/Detachment of Paper Feed Cassette and for Detection of Conveyance of Sheet FIG. 5 is a plan view of the paper feed cassette (showing only the front portion side thereof). FIG. 6 is a sectional view taken along line VI-VI in FIG. 5. FIG. 7 is an enlarged view of a part A in FIG. 3. FIG. 8 is a sectional view showing the first attitude of the swing link (a sectional view taken along line VIII-VIII in FIG. 5), FIG. 9 is a sectional view showing the second attitude of the swing link, and FIG. 10 is a sectional view showing the third attitude of the swing link. FIG. 12 is a sectional view in the case where a protrusive portion is disposed on the upstream side of the separation roller.

First, the configuration of the swing link 80 will be described, followed by the description of changes in the attitude of the swing link 80 attendant upon the conveyance of the sheet 3 and the detachment of the paper feed cassette 9.

As shown in FIGS. 5 and 7, the swing link 80 includes a tubular body portion 81. The body portion 81 includes a thin-walled small-diameter portion 81A and a thick-walled large-diameter portion 81B which are connected to each other, and it is fitted round the center shaft C1 with some gap therebetween so as to be floatingly turnable (the body portion 81 does not turn unitarily with the center shaft C1, but it turns freely). Besides, the small-diameter portion 81A is provided with an arm 84, and the large-diameter portion 81B is provided with a protrusive plate portion (corresponding to a "protrusive portion" in the invention) 95 for the paper feed cassette 9.

The arm 84 is stretched upward from the outer periphery of the small-diameter portion 81A, and a shield plate (corresponding to a "shield portion" in the invention) 85 is formed at one end face of the arm 84 (an end face on this side as seen in FIG. 7), while a reinforcement wall 86 is formed at the end face of the arm 84 on the opposite side (an end face on the back side as seen in FIG. 7).

The shield plate 85 defines the shape of a substantially rectangular flat plate extending along the longitudinal direction of the paper feed cassette 9 (the X-axial direction of the apparatus body), above the arm 84. On the other hand, the reinforcement wall 86 is formed over substantially the whole height of the arm 84. The distal end side of the reinforcement wall 86 is formed having a predetermined width, whereas the base end side thereof is formed to be broader than the distal end side. Besides, a hooked spring retainer 88 is formed on the base end side of the reinforcement wall 86 and on a left front side as seen in FIG. 7.

Here, a photoelectric sensor 100 for detecting a light intercepting object as forms the opposite side of the shield plate 85 will be described. The photoelectric sensor 100 is constructed of a pair of light projecting and receiving elements which are arranged in opposition (this embodiment uses a photointerrupter of transmission type in which these photoelectric elements are packaged).

The photoelectric sensor 100 is fixed to the upper position of the swing link 80 in the ceiling wall of the cassette accommodation portion 2A, at an attitude at which its optical axis lies along the center shaft C1 of the separation roller 10. This photoelectric sensor 100 is set so that the shield portion 85 of the swing link 80 may lie between the light projecting and light receiving elements, in a mounted state (a state where the photoelectric sensor 100, swing link 80 and paper feed cassette 9 are mounted, and where the sheet 3 is not conveyed)

As shown in FIG. 5, the protrusive plate portion 95 is stretched from the outer peripheral surface of the large-diameter portion 81B toward the wall portion 75 of the paper feed cassette 9. Regarding the width of the protrusive plate portion 95, the distal end side thereof is formed to be somewhat narrow, whereas the base end side thereof is formed over the full width of the large-diameter portion 81B. Moreover, the end face part of the protrusive plate portion 95 on a right side in FIG. 5 is shaped so as to continue to the reinforcement wall 86.

Meanwhile, as shown in FIGS. 7 and 8, a receiver portion 79 with the wall surface depressed downward is provided at the position of the wall portion 75 opposing to the protrusive plate portion 95. The bottom wall of the receiver portion 79 is configured of a flat seat surface 79A for bearing the protrusive plate portion 95, and a guiding inclined surface 79B for guiding the protrusive plate portion 95 onto the seat surface 79A with the operation of attaching the paper feed cassette 9. Besides, as shown in the figures, the distal end of the protrusive plate portion 95 has a somewhat crooked shape.

Next, the changes of the attitude of the swing link 80 will be described.

<First Attitude>

When the paper feed cassette 9 is assembled to the cassette accommodation portion 2A, the protrusive plate portion 95 falls into a state shown in FIG. 8 where it traverses the sheet conveyance path 56 and where its bent part at the distal end advances onto the seat surface 79A of the receiver portion 79. On this occasion, the arm 84 assumes an attitude at which it stands erect substantially perpendicularly, and the shield plate 85 is in a state where it cuts off the optical path of detection light projected from the light projecting element (hereinbelow, the state shall be expressed as the "state where a sensor output is OFF"). Such an attitude where the protrusive plate portion 95 is borne on the seat surface 79A of the receiver portion 79, shall be termed the "first attitude of the swing link 80".

Besides, numeral 110 in FIG. 8 designates a coiled spring (functioning "an urging portion"). The coiled spring 110 has one end retained at the ceiling wall of the cassette accommodation portion 2A and has the other end retained at the spring retainer 88 of the swing link 80, and it urges the swing link 80 in an direction S indicated in the figure, when the swing link 80 lies at the first attitude.

<Second Attitude>

In the state before the conveyance, the protrusive plate portion 95 traverses the sheet conveyance path 56, so that when the conveyance of the sheet 3 begins, the protrusive plate portion 95 is caused to leap up by the sheet 3. Thus, the swing link 80 is turned in the direction of arrow (direction R) indicated in FIG. 9. Besides, owing to the turning, the shield plate 85 gets out of the optical path of the detection light. Thus, the photoelectric sensor 100 falls into a light reception state (hereinbelow, the state shall be expressed as the "state where the sensor output is ON"). Such an attitude shown in FIG. 9 where the protrusive plate portion 95 is caused to leap up, shall be termed the "second attitude of the swing link 80".

Here, during the conveyance of the sheet 3, the swing link 80 lies in the state where the lower surface of the protrusive plate portion 95 is supported by the sheet 3, and hence, it keeps the second attitude. However, when the rear end of the sheet 3 has passed through the protrusive plate portion 95, this protrusive plate portion 95 consequently loses the support of the sheet 3 (or falls into a free state), and hence, the swing link 80 is returned to the original attitude (first attitude) under the action of an urging force based on the coiled spring 110 described before.

<Third Attitude>

Next, when the paper feed cassette 9 is detached from the state of FIG. 8 (the whole cassette is moved rightward as seen in the figure), the state where the protrusive plate portion 95 is borne on the receiver portion 79 is released as shown in FIG. 10. Immediately after the release, the swing link 80 is turned in the S direction indicated in FIG. 10, because it is in the state where it receives the urging force of the coiled spring 110. Besides, the swing link 80 is provided with a stopper (not shown), and the turning is stopped when the stopper abuts on the end face of the separation roller 10. On this occasion, the shield plate 85 gets out of the optical path of the detection light. Thus, the photoelectric sensor 100 falls into a light reception state (ON state). Such an attitude shall be termed the "third attitude of the swing link 80".

Incidentally, the first attitude, second attitude and third attitude of the swing link correspond to "swing positions" in the invention.

Meanwhile, when the paper feed cassette 9 is inserted into the cassette accommodation portion 2A from the state of the third attitude this time, the bent part of the protrusive plate portion 95 at the distal end there of collides against the guiding inclined surface 79B of the wall portion 75. Thereafter, the swing link 80 is turned under a guiding action based on the guiding inclined surface 79B, and against the urging force of the coiled spring 110. When the paper feed cassette 9 has been accommodated in the cassette accommodation portion 2A in due course, the protrusive plate portion 95 falls into a state where it climbs up the guiding inclined surface 79B to be borne on the seat surface 79A of the receiver portion 79, that is, the swing link 80 assumes the first attitude shown in FIG. 8.

In this manner, the distal end of the protrusive plate portion 95 is bent, and the wall portion 75 on the opposite side is provided with the guiding inclined surface 79B, whereby in attaching the paper feed cassette 9 into the cassette accommodation portion 2A, the guidance of the protrusive plate portion 95 to the seat surface 79A is smoothly effected. Therefore, the protrusive plate portion 95 is prevented from tightening and damaging after having collided against the wall portion 75.

Figure 11:
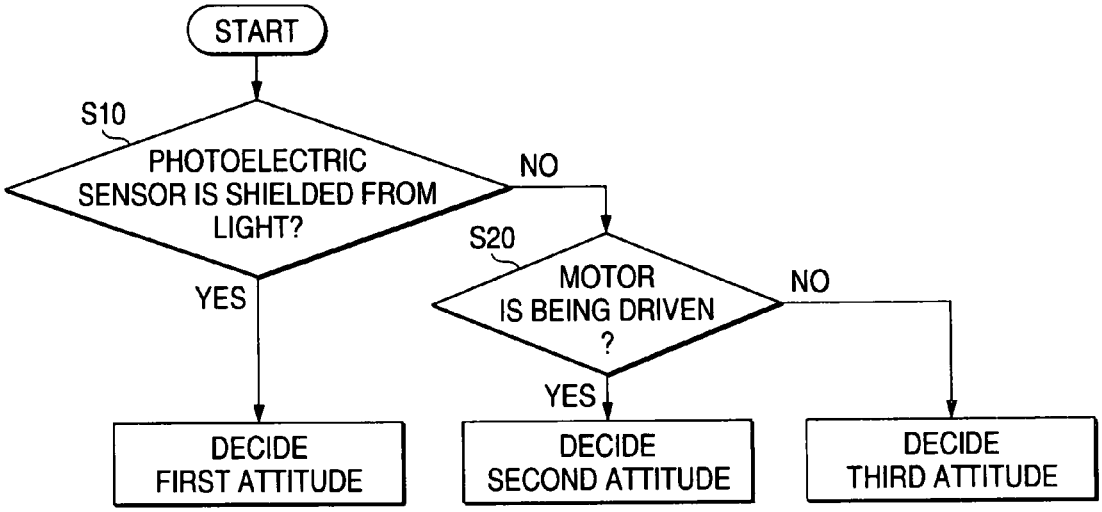
FIG. 11 is a flowchart showing a process in which the attitude of the swing link is decided.

Next, there will be described the detection of the change of the attitude of the swing link 80 and the specification of the attitude. FIG. 11 is a flow chart showing a process for deciding the attitude of the swing link 80.

In a set state where the paper feed cassette 9 is set in the cassette accommodation portion 2A and where the sheet 3 is not being conveyed, the swing link 80 assumes the first attitude, and the photoelectric sensor 100 lies in a light shield state. In contrast, when the conveyance of the sheet 3 or the detachment of the paper feed cassette 9 is performed from such a state, the swing link 80 changes its attitude so that the shield plate 85 may get out of the optical path of the detection light, whereby the photoelectric sensor 100 falls into the light reception state.

As indicated in FIG. 11, therefore, whether or not the photoelectric sensor 100 is in the light shield state is decided at a step S10. Thus, it is possible to detect whether the swing link 80 lies at the first attitude, or it has changed its attitude from the first attitude being a reference (the detection of the change of the attitude).

Besides, in a case where it has been decided at the step S10 that the photoelectric sensor 100 is in the light reception state, in other words, that the attitude of the swing link 80 has changed, the process shifts to a step S20 so as to decide whether or not the motor M is being driven. The photoelectric sensor 100 falls into the light reception state in either of two change patterns; a case where the swing link 80 changes from the first attitude being the reference, to the second attitude, and a case where it changes from the first attitude to the third attitude. In this regard, the second attitude corresponds to the conveyance of the sheet 3, and the third attitude corresponds to the detachment of the paper feed cassette 9.

Here, whenever the sheet 3 is being conveyed, the driving motor M is being driven without fail. In contrast, as stated before, the driving motor M is controlled so as to stop when the paper feed cassette 9 has been detached. Therefore, if the motor M is being driven, it can be decided that the swing link 80 lies at the second attitude, in other words, that the sheet 3 is being conveyed, and if the motor M is in the stopped state, it can be decided that the swing link 80 lies at the third attitude, in other words, that the paper feed cassette 9 has been pulled out (the specification of the attitude).

Incidentally, the decision on the light shield or light reception of the photoelectric sensor 100 is rendered by the control device on the basis of a light reception signal from the light receiving element, and the decision on the drive of the motor M is rendered by the control device on the basis of a pulse signal from a speed-controlling rotary encoder (functioning as "a second detection unit") which is associated with the motor M.

Besides, when the sheet conveyance has been decided, the conveyance timing of the sheet to be subsequently sent is determined by the gist to be stated below, on the basis of the ON/OFF states of the photoelectric sensor 100 at that time.

First, the passage of the front end of the sheet 3 can be detected by detecting a timing at which the photoelectric sensor 100 switches from the OFF state (light shield) into the ON state (light reception at the second attitude). To the contrary, the passage of the rear end of the sheet 3 can be detected by detecting a timing at which the photoelectric sensor 100 switches from the ON state (light reception at the second attitude) into the OFF state (light shield).

Here, for determining the conveyance timing, there are a method in which the passage of the front end of the sheet 3 is set as a reference, and a method in which the passage of the rear end of the sheet 3 is set as a reference. The latter is employed in this embodiment, that is, the next sheet 3 is conveyed after confirming that the passage of the rear end of the single sheet 3 has been detected. Owing to such a control, a maloperation in which the next sheet 3 is conveyed before the completion of the conveyance of the single sheet 3 can be prevented from occurring.

Besides, in determining such a conveyance timing of the sheet 3, a conveyance interval should desirably be shortened to the utmost in view of a request for the higher speed of printing. In this regard, in this embodiment, the coiled spring 110 is disposed to urge the swing link 80 in the returning direction (in the direction in which the swing link 80 returns from the second attitude to the first attitude) as stated before. Accordingly, a returning time period (a time period in which the swing link 80 returns from the second attitude to the first attitude) shortens to that extent as compared with a returning time period in the case where no urging portion is disposed. Therefore, the lag of the timing of the turn-ON/OFF of the photoelectric sensor 100 with respect to the conveyance of the sheet 3 can be shortened. Consequently, when the conveyance timing of the sheet 3 is determined on the basis of the turn-ON/OFF, an error corresponding to the lag of the detection can be excluded, with the result that the conveyance interval can be set at the shortest time period.

Besides, for detecting the rear end of the sheet 3, the swing link 80 needs to be set so that it may return from the second attitude to the first attitude without fail each time the single sheet 3 passes. In this embodiment, therefore, the protrusive plate portion 95 is arranged so as to lie on the downstream side of the sheet conveyance path 56 (right side in FIG. 8) relative to the separation roller 10. Assuming that, as shown in FIG. 12, a protrusive plate portion 130 is disposed on an upstream side relative to the separation roller 10, the sheets of paper 3 are not separated yet there, and hence, it can occur that the sheets of paper 3 underlie the protrusive plate portion 95 in a stacked state.

In such a situation, even if one of the stacked sheets of paper 3 has passed, the swing link 80 does not return to the first attitude, and hence, the rear end of the sheet 3 cannot be detected. In contrast, with the above configuration (the configuration in which the protrusive plate portion 95 is arranged downstream of the separation roller 10), the swing link 80 returns to the first attitude without fail simultaneously with the passage of the sheet 3.

Besides, owing to the provision of the coiled spring 110, the attitude change from the first attitude to the third attitude is quickened in addition to the attitude change from the second attitude to the first attitude as explained above. Therefore, the detection of the detachment of the paper feed cassette 9 can also be done earlier.

Next, the operations and advantages of this embodiment will be described.

According to this embodiment, the swing link 80 has its attitude (swing position) changed by the detachment of the paper feed cassette 9 or the conveyance of the sheet. Concretely, before the sheet 3 is conveyed, the swing link 80 is in the state (first attitude) where it is borne on the receiver portion 79 of the paper feed cassette 9. When the sheet 3 is conveyed, a support point moves from the side of the paper feed cassette 9 to the sheet 3. Owing to the movement of the support point, the attitude of the swing link 80 changes from the first attitude to the second attitude.

On the other hand, when the paper feed cassette 9 is detached, the bearing by the receiver portion 79 is released, and hence, the swing link 80 falls into an unsupported state thenceforth. Owing to the change of the support, the attitude of the swing link 80 changes from the first attitude to the third attitude. Accordingly, both the conveyance of the sheet 3 and the detachment of the paper feed cassette 9 can be known by detecting the change of the attitude of the swing link 80.

With the configuration in which, in this manner, the attitude changes in interlocking with both the sheet conveyance and the detachment of the paper feed cassette 9, the swing link 80 has both the function of detecting the sheet conveyance and the function of detecting the detachment of the paper feed cassette 9. Accordingly, the general configuration of the device can be simplified in mechanism more than in a case where the respective functions are incarnated by individual constituents, that is, where a detection device for detecting the detachment of the paper feed cassette 9 and a detection device for detecting the sheet conveyance are separately installed in places spaced from each other.

Besides, the photoelectric sensor 100 and the rotary encoder are used for specifying the attitude of the swing link 80. However, the rotary encoder is a component originally required for controlling the drive of the motor M, and it is not a dedicated component for deciding the attitude of the swing link 80. The detection of the detachment of the paper feed cassette 9 and that of the conveyance of the sheet are effected by adding substantially the two components of the photoelectric sensor 100 and the swing link 80 in this embodiment. In this manner, the number of components may be small in itself, so that this embodiment contributes to curtailment in cost.

Furthermore, the swing link 80 is arranged in parallel with the separation roller 10, and the arrangement corresponds to the central part of the paper feed cassette 9 in the widthwise direction thereof. With such a configuration, the number of components can be made smaller than in a case where dedicated shafts are provided for both the separation roller 10 and the swing link 80, and the central part of the sheet 3 collides against the protrusive plate portion 95 of the swing link 80, so that the swing link 80 can be caused to leap up more reliably.

Besides, part of the sheet conveyance path 56 is formed of the guide pieces 115 of the paper feed cassette 9. With such a configuration, the sheet conveyance path 56 is formed using the originally required components, so that simplification in the apparatus is achieved.

In addition, this embodiment features the point that the swing link 80 changes its attitude in abutment on the paper feed cassette 9 or the sheet 3 (contact type). On the other hand, the detection type may well be a noncontact type in which detection light is directly projected onto the sheet 3 or the paper feed cassette 9 so as to detect light shield, whereby the presence or absence of the sheet 3 or the paper feed cassette 9 is detected. However, the non contact type has the problem that, when the sheet or the like is of a transparent transmissible material by way of example, the detection is impossible. In contrast, with the contact type, the detection is possible irrespective of the material of the sheet.

<Other Embodiments>

The present invention is not restricted to the above embodiment described with reference to the drawings, but embodiments to be stated below, for example, shall be covered within the technical scope of the invention. Further, apart from the ensuing description, the invention can be performed through various alterations within a scope not departing from the purport thereof.

(1) In the foregoing embodiment, the changes of the attitude of the swing link 80 have been detected on the basis of the state of the photoelectric sensor 100 and the drive of the motor M. By way of example, however, a proximity sensor may well be arranged in the vicinity of the swing link 80 so as to detect fluctuations in the position of the swing link 80 relative to the proximity sensor (the displacements of the free end of the swing link 80 attendant upon turning). With such a configuration, the attitude of the swing link 80 can be specified from the magnitude of the displacement of the free end part of the swing link 80.

(2) In the foregoing embodiment, the photoelectric sensor 100 has been set so as to be shielded from the light in the case of the first attitude, and to receive the light in the cases of the other attitudes. This photoelectric sensor 100, however, may well receive the light in the case of the first attitude and be shielded from the light in the cases of the other attitudes. Incidentally, on this occasion, a plurality of shield portions need to be disposed for the swing link 80.

(3) The foregoing embodiment has been configured so as to bring the distal end of the protrusive plate portion 95 into abutment on the paper feed cassette 9, but a portion for abutment on the paper feed cassette 9 may well be disposed separately from the protrusive plate portion 95.

Figure 13:
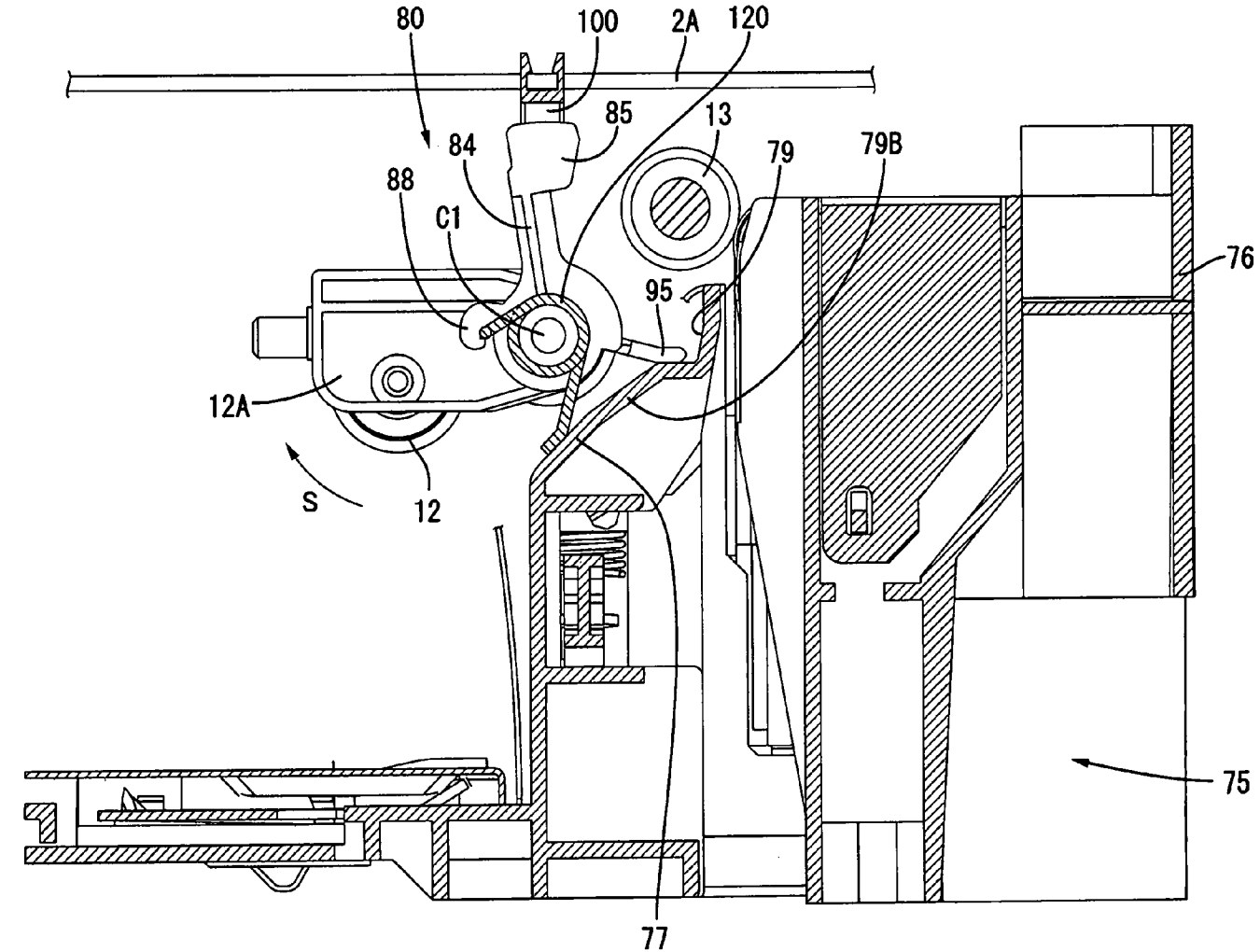
FIG. 13 is a sectional view showing a modified embodiment (in which an urging portion is constructed of a torsion spring).

(4) In the foregoing embodiment, the urging portion has been constructed of the coiled spring 110, but it may well be constructed of a torsion spring. In this case, the torsion spring 120 may be outserted onto the center shaft C1 as shown in FIG. 13.

(5) In the foregoing embodiment, the coiled spring 110 has been disposed in the cassette accommodation portion 2A in order to quicken the responses of the swing link 80 to the conveyance of the sheet 3 and the detachment of the paper feed cassette 9. However, the coiled spring 110 is not an indispensable constituent, but the attitude of the swing link 80 may well be changed by utilizing the weight of the swing link itself.

(6) In the foregoing embodiment, the paper feed cassette 9 and the structure for accommodating the paper feed cassette 9 in the body casing may be configured as explained in the following embodiment.

Figure 14:
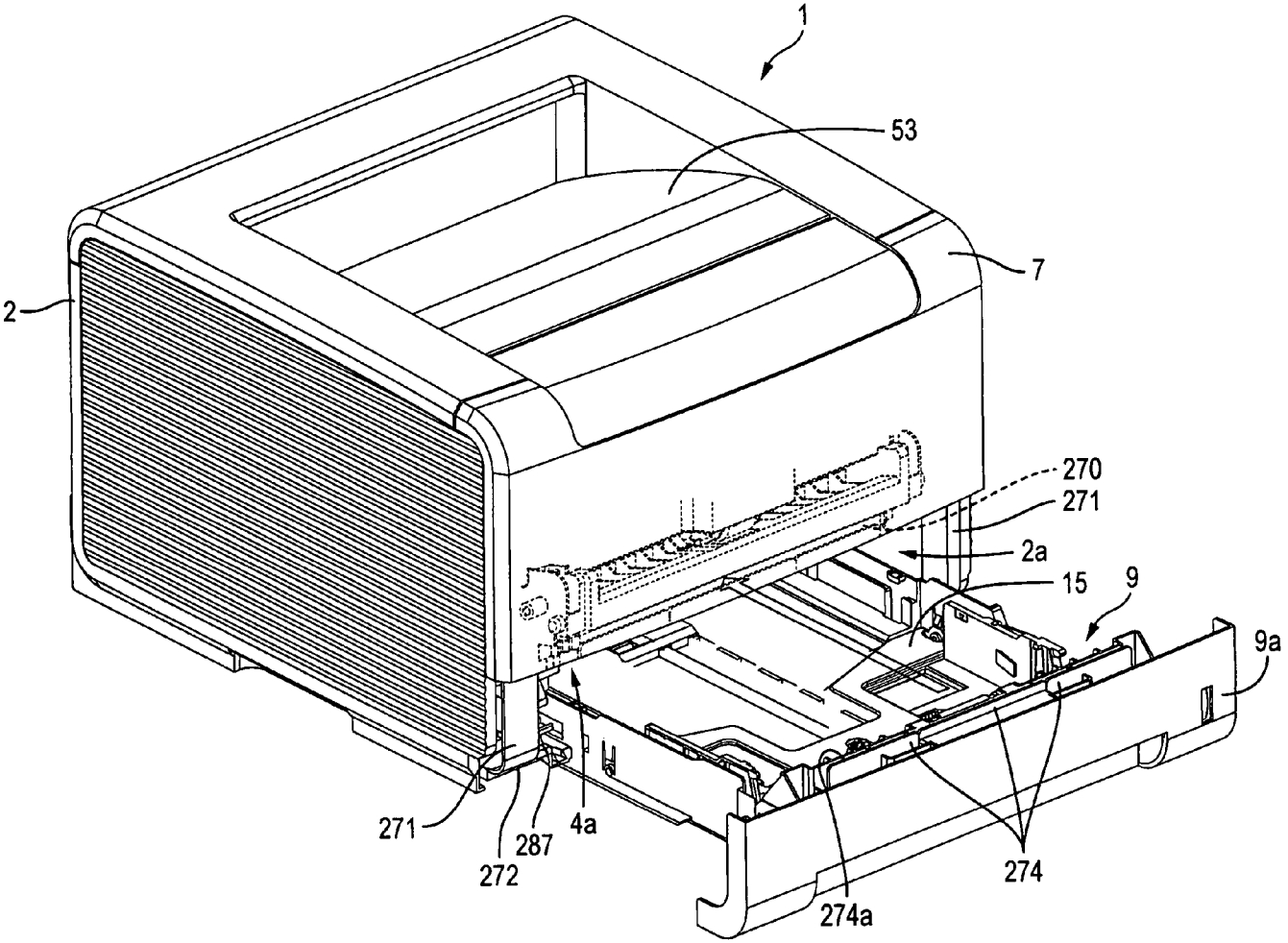
FIG. 14 is a perspective view of a laser printer according to another embodiment in a state where a paper feed cassette has been pulled out.

FIGS. 14-20 illustrate another embodiment of the invention. In this embodiment, the paper feed cassette 9 is pulled out as shown in FIG. 14. Hereinafter, the side of the laser printer 1 on which the front cover 7 is disposed shall be termed the "front side", and the opposite side thereof the "rear side". Besides, the laser printer 1 in a state where the paper feed cassette 9 has been detached functions as an "apparatus body 1*a*".

As shown in FIG. 2, the paper feed cassette 9 in which the sheets of paper 3 before printing are accommodated is disposed under the front cover 7 in such a manner that this paper feed cassette can be pulled out from the front side.

Figure 15:
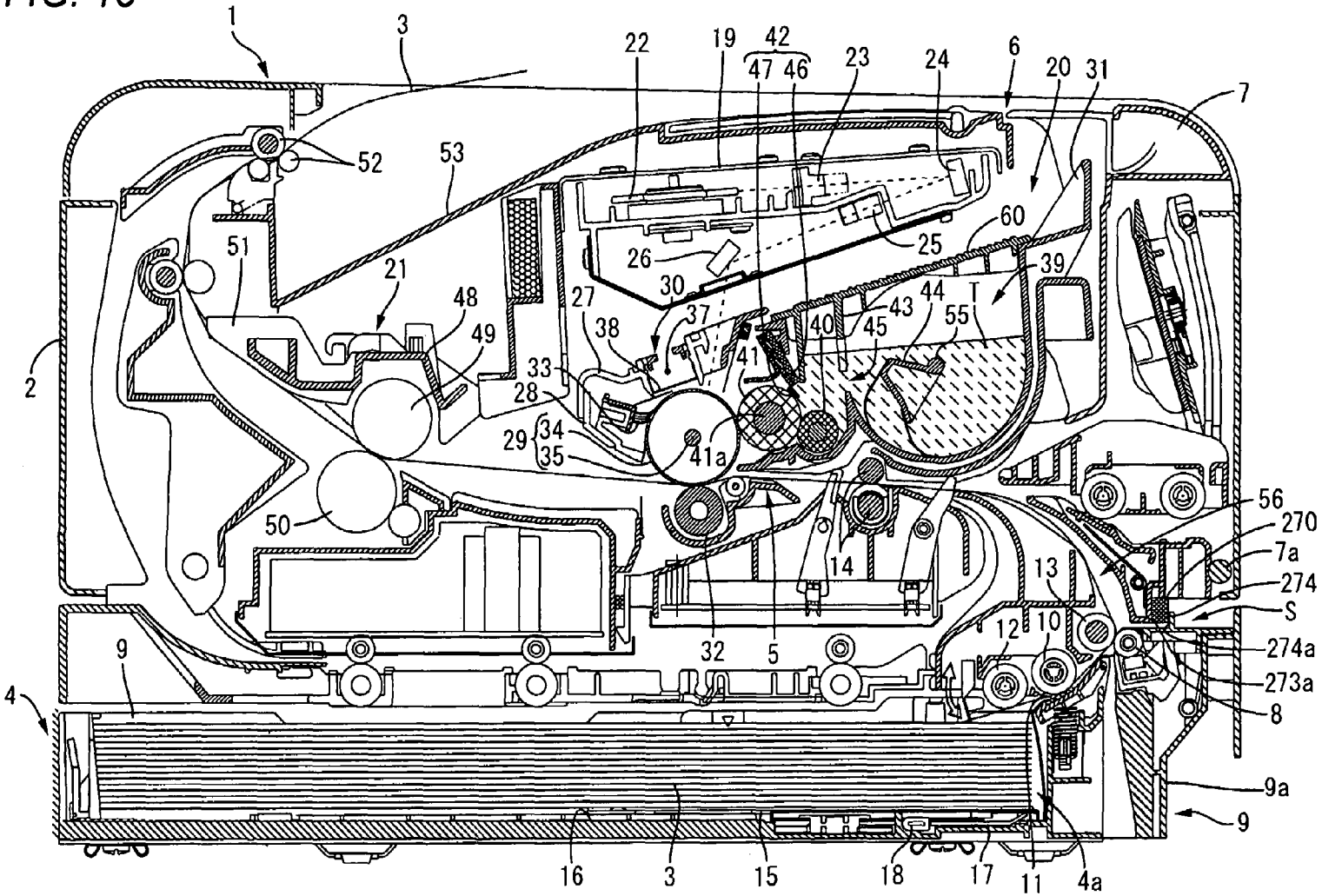
FIG. 15 is a side sectional view of the essential portions of the laser printer.

As shown in FIG. 15, the U-shaped conveyance path 56 is partly formed of the separation pad 11 and paper-powder removal roller 8 on the side of the paper feed cassette 9, and the separation roller 10 and opposition roller 13 on the side of the apparatus body 1*a*, in the state where the paper feed cassette 9 is accommodated in the cassette accommodation portion 4*a*. Besides, the conveyance path 56 is continuous to the gap S between the upper part of the front side of the paper feed cassette 9 and the body casing 2. The gap S serves to secure a space which is necessary for smoothly opening and closing the front cover 7 about the cover shaft 7*a*. In the conveyance process of the sheet 3, accordingly, the rustlings of the sheet 3 which is conveyed between the separation roller 10 and the separation pad 11 and between the paper-powder removal roller 8 and the opposition roller 13 come out especially from the gap S.

Figure 16:
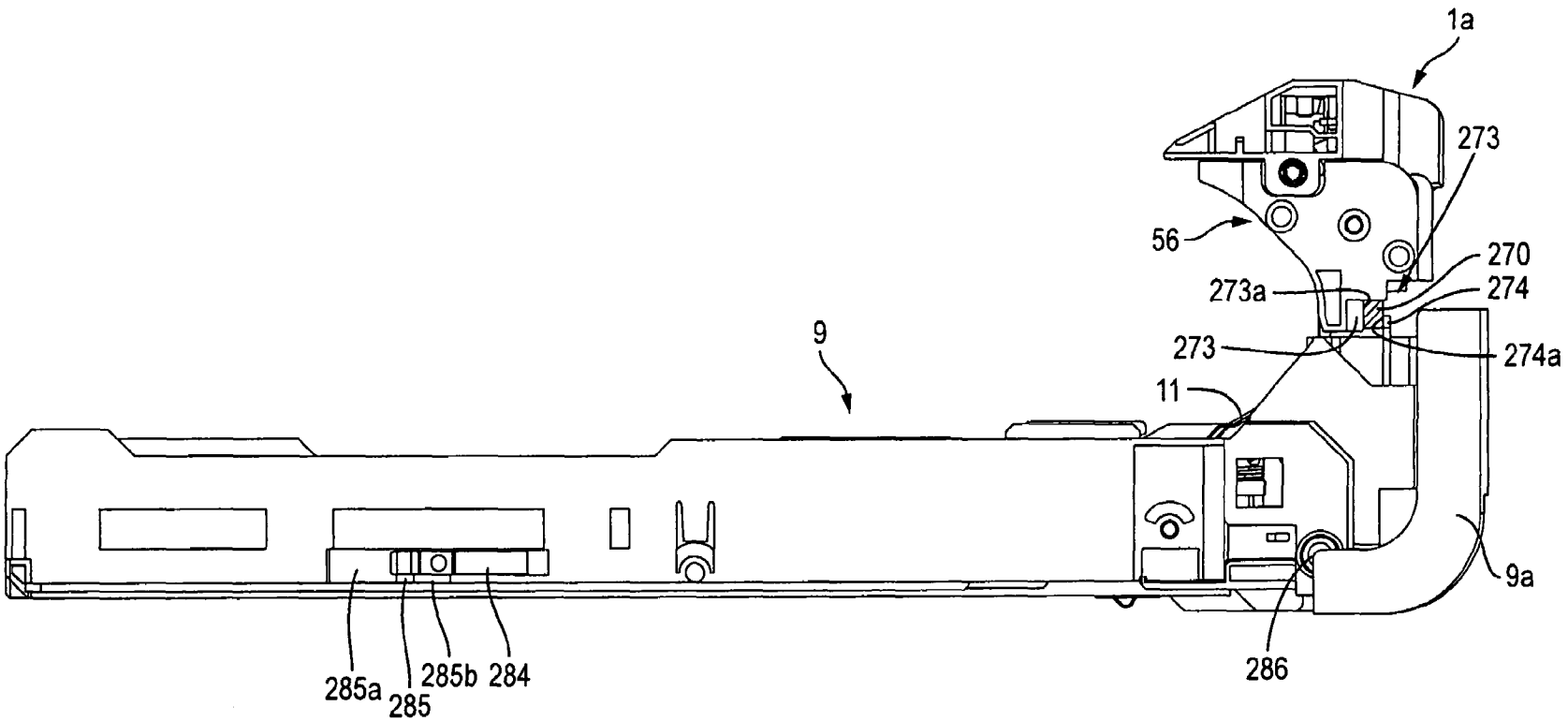
FIG. 16 is a partial side view showing the paper feed cassette, and a part of an apparatus body at which the upper peripheral edge part of an opening is formed.
Figure 17:
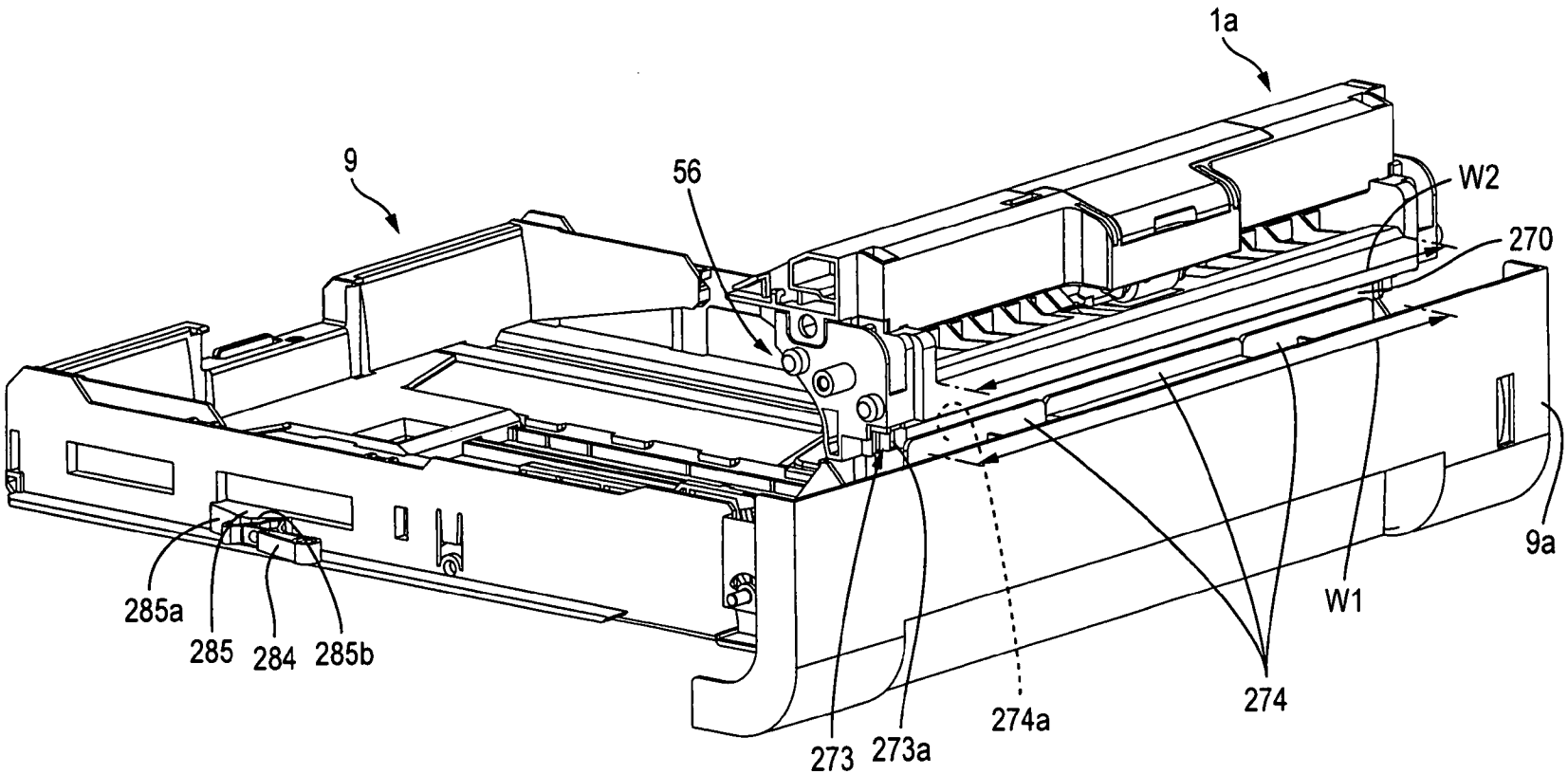
FIG. 17 is a partial perspective view (I) showing the paper feed cassette, and the part of the apparatus body at which the upper peripheral edge part of the opening is formed.

In this embodiment, therefore, a sponge member 270 is disposed so as to close the gap S. FIG. 15 is a partial side view showing the paper feed cassette 9, and that part of the body casing 2 at which the upper peripheral edge part 273 of the opening 2*a* is formed. Besides, FIGS. 16 and 17 are corresponding perspective views (I and II).

Specifically, as shown in FIGS. 14 and 15, the front end of the paper feed cassette 9 is unitarily provided with a cover wall 9*a* which covers the peripheral edge part of the opening 2*a* from the front and over the whole periphery of this peripheral edge part, in the state where the paper feed cassette 9 is accommodated in the cassette accommodation portion 4*a*. The cover wall 9*a* is formed in such a shape that the right and left peripheral edge parts 271 and lower peripheral edge part 272 (See FIG. 14.) of the opening 2*a* are substantially completely covered from the front. Accordingly, the rustlings do not considerably come out from the peripheral edge parts 271 and 272.

In contrast, the cover wall 9*a* is in such a shape that the upper peripheral edge part 273 of the opening 2*a* is covered from the front, with the gap S left between this cover wall 9*a* and the lower end part of the front cover 7 located above. Besides, as shown in FIGS. 14-16, the cover wall 9*a* is formed with keeper walls 274 which are erected upward, and which have a width (width W1 indicated in FIG. 5) being somewhat larger than the lateral width of the conveyance path 56 (that width of the sheet 3 which can be accommodated in the paper feed cassette 9, for example, the smaller one of the widths of the A4-format and the letter size, and which is a width W2 indicated in FIGS. 17 and 18).

On the other hand, that upper peripheral edge part 273 of the opening 2*a* which lies on the rear side with respect to the front cover 7 on the side of the apparatus body 1*a*, similarly has the width W1 being somewhat larger than the lateral width W2 of the conveyance path 56. Besides, the lower end part of the upper peripheral edge part 273 is covered from the front, with the upper end parts of the keeper walls 274 in the direction of pulling out the paper feed cassette 9 (the right and left direction of the sheet of drawing as seen in FIG. 15). Here, the respective opposing surfaces 273*a* and 274*a* of the upper peripheral edge part 273 and the keeper walls 274 (corresponding to "first surface" and "second surface" in the invention) define surfaces orthogonal to the pulling-out direction, and the sponge 270 is stuck over the full length of the opposing surface 273*a* with, for example, an adhesive.

Figure 18:
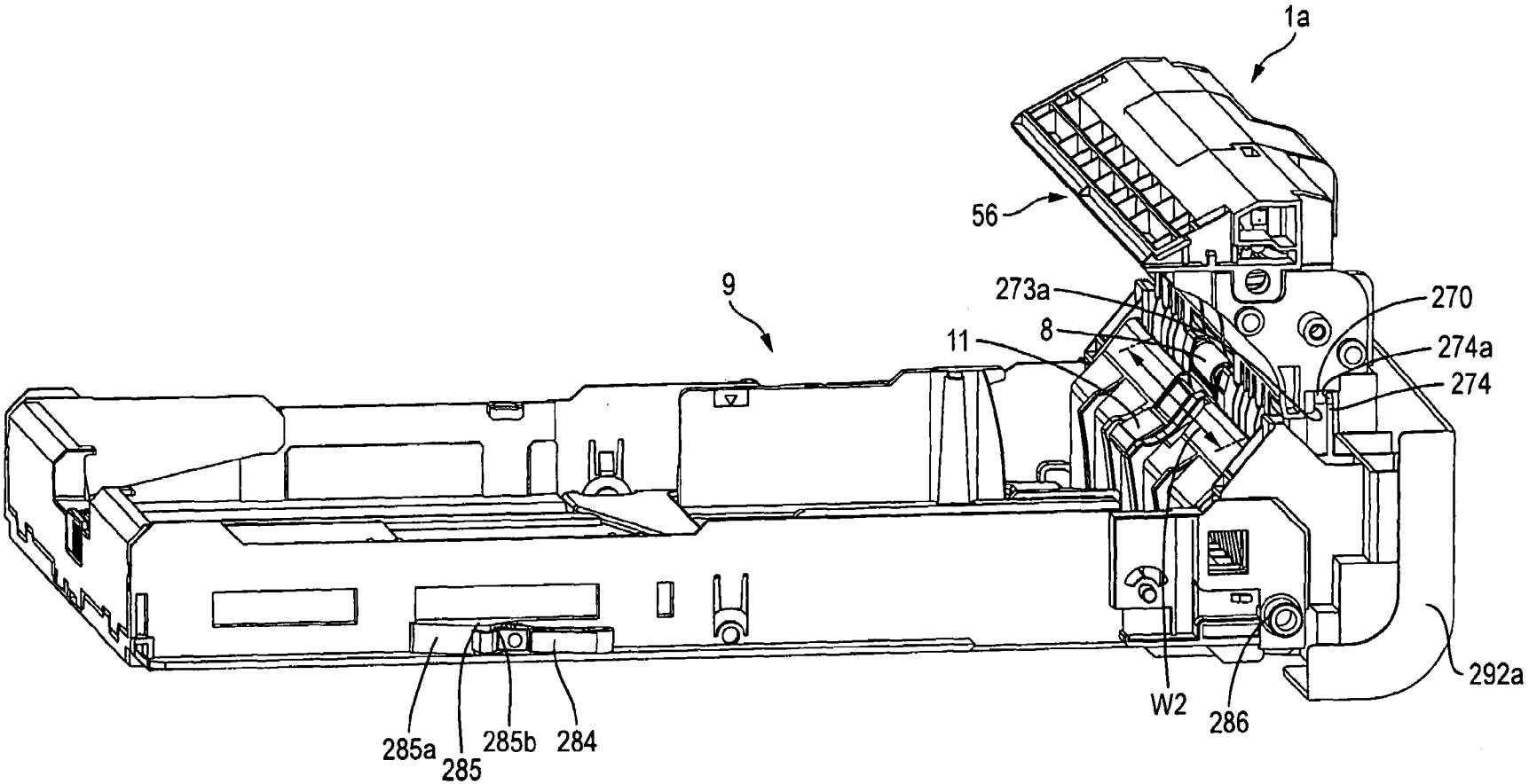
FIG. 18 is a partial perspective view (II) showing the paper feed cassette, and the part of the apparatus body at which the upper peripheral edge part of the opening is formed.

Besides, as shown in FIGS. 16-18, the sponge 270 is pressed between the opposing surfaces 273*a* and 274*a* and is elastically deformed in the state where the paper feed cassette 9 is accommodated in the cassette accommodation portion 4*a*. Thus, the gap S is closed, and the rustlings can be prevented from coming out. Incidentally, the sponge 270 is arranged so as not to project below the opposing surface 273*a*. Essentially, the sponge 270 is arranged so as not to interfere with the various parts of the paper feed cassette 9 in attaching/detaching this paper feed cassette 9.

Figure 19:
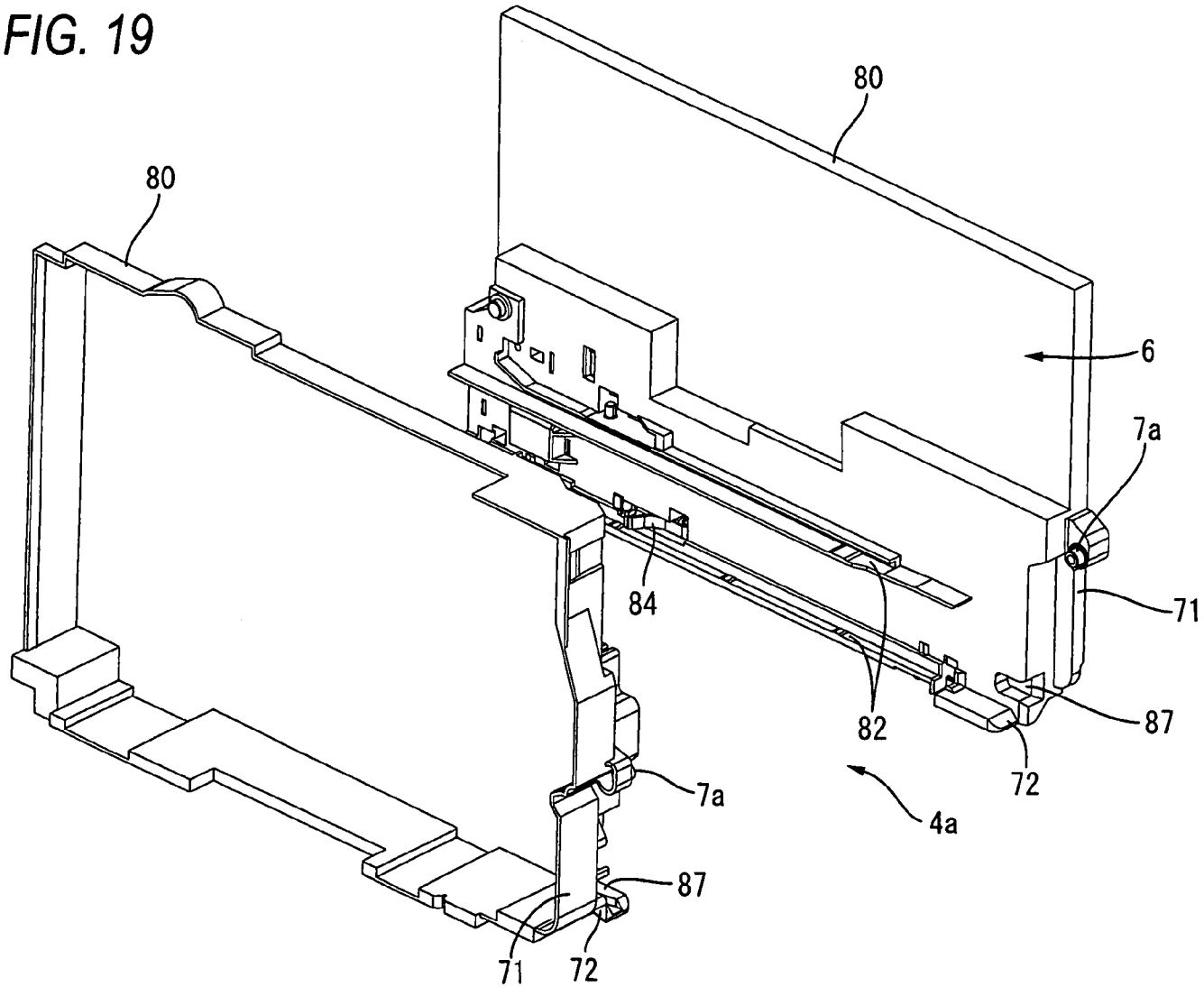
FIG. 19 is a perspective view showing a pair of inwall plates.
Figure 20:
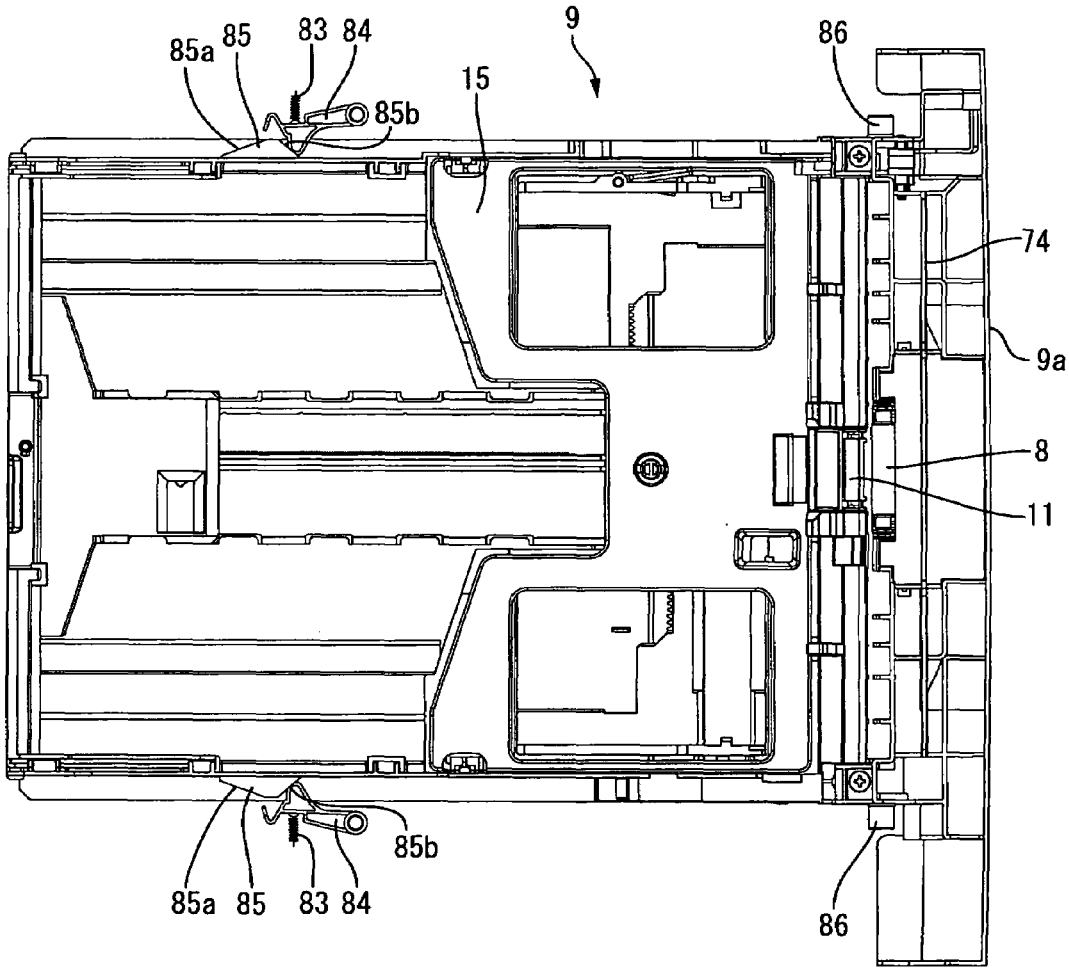
FIG. 20 is a plan view of the paper feed cassette.

This embodiment is provided with a holding unit for holding the paper feed cassette 9 in the cassette accommodation portion 4*a* against the reaction force of the pressed sponge 270 when the paper feed cassette 9 has been accommodated in the cassette accommodation portion 4*a*. FIG. 19 is a perspective view showing a pair of inwall plates 280 and 280 which form a frame inside the body casing 2, and which are arranged so as to hold the cassette accommodation portion 4*a* in the widthwise direction therebetween. FIG. 20 is a plan view of the paper feed cassette 9.

As shown in FIG. 7, guide grooves 281 and 281 for guiding the process cartridge 20 are formed at the upper parts of the opposing surfaces of the pair of inwall plates 280 and 280, so as to be continuous to the attachment/detachment port 6. Besides, guide ribs 282 for guiding the paper feed cassette 9 into the cassette accommodation portion 4*a* (in the figure, only the guide ribs 282 of the inwall plate 280 on the deep side on the sheet of drawing are shown) are stretched along the pulling-out direction, at the lower parts of the opposing surfaces of the pair of inwall plates 280 and 280. In addition, engagement stopper pieces 284 are respectively disposed at the lower parts of the opposing surfaces of the inwall plates 280 and 280 as are nearer to the rear ends of these inwall plates. Each of the engagement stopper pieces 284 is supported so as to be turnable between an attitude where it protrudes inward of the cassette accommodation portion 4*a* and an attitude where it has retreated within the corresponding inwall plate 280, and it is urged onto the side of the protruding attitude by a spring 83 which functions as an urging portion (refer also to FIG. 20).

On the other hand, on the side of the paper feed cassette 9, engagement saliences 285 with which the engagement stopper pieces 284 are engaged are respectively disposed on the right and left side surfaces of the paper feed cassette 9. As shown in FIG. 8, each of the engagement saliences 285 is formed in a conical shape as seen from above. In attaching the paper feed cassette 9 into the cassette accommodation portion 4*a*, each of the engagement saliences 285 guides the corresponding engagement stopper piece 284 from the protruding attitude to the retreating attitude by the oblique surface 85*a* of this engagement salience on the rear side thereof.

Further, since the paper feed cassette 9 is inserted onto the deeper side of the cassette accommodation portion 4*a*, each of the engagement stopper pieces 284 gets over the distal end part of the corresponding engagement salience 285, thereby to be guided by the oblique surface 285*b* of the engagement salience 285 on the front side thereof and to be returned to the protruding attitude. Incidentally, the oblique surface 285*b* on the front side is an inclined surface which is more abrupt than the oblique surface 285*a* on the rear side. In this manner, owing to the engagements between the engagement stopper pieces 284 and the engagement saliences 285, the paper feed cassette 9 is held by the apparatus body 1*a* against the reaction force of the sponge 270.

As shown in FIG. 20, the front end s ides of the side surfaces of the paper feed cassette 9 are respectively provided with columnar positioning protrusions 286 and 286. On the other hand, as shown in FIG. 19, the right and left peripheral edge parts 271 of the inwall plates 280 are respectively formed with positioning recesses 287 with which the corresponding positioning protrusions 286 are engaged in the state where the paper feed cassette 9 is accommodated in the cassette accommodation portion 4*a*. In the state where the engagement stopper pieces 284 and the corresponding engagement saliences 285 are held in engagements, the positioning protrusions 286 and the corresponding positioning recesses 287 abut on each other and position the paper feed cassette 9 to the apparatus body 1*a* against the engagement forces of the positioning protrusions 286 and the corresponding positioning recesses 287, and the reaction force of the sponge 270.

This embodiment has the configuration in which the sponge 270 is held between the opposing surface 273*a* of the upper peripheral edge part 273 (first surface) and the opposing surfaces 274*a* of the keeper walls 274 (second surface) as have planes orthogonal to the pulling-out direction of the paper feed cassette 9. Thus, the rustlings can be restrained by the sponge 270 from coming outside from between the opening 2*a* and the paper feed cassette 9. Moreover, the sponge 270 can be restrained from being torn off or frictionally worn away in the operation of pulling out the paper feed cassette 9.

Besides, the opposing surface 273*a* and the opposing surfaces 274*a* are the surfaces orthogonal to the pulling-out direction of the paper feed cassette 9. Accordingly, the holding force between the opening 2*a* of the apparatus body 1*a* and the cover wall 9*a* of the paper feed cassette 9 can be more efficiently given to the sponge 270, and the sealability of the gap S can be more heightened, than in a configuration in which the opposing surface 273*a* and the opposing surfaces 274*a* have an inclination angle relative to the pulling-out direction.

The sponge 270 is arranged at the upper peripheral edge part 273 which is deeper with a level difference from the body casing 2. Accordingly, even in the state where the paper feed cassette 9 is taken out, the sponge 270 is difficult to see from outside, and degradation in the design quality of the whole apparatus is avoidable (refer to FIG. 14). Besides, the sponge 270 is arranged at the opposing surface 273*a* without projecting onto the side of the paper feed cassette 9, and it can therefore be prevented from being torn off in touch with the paper feed cassette 9 when this paper feed cassette 9 is attached/detached.

Besides, owing to the engagements between the engagement stopper pieces 284 and the corresponding engagement saliences 285, the paper feed cassette 9 is held by the apparatus body 1*a* against the reaction force of the sponge 270, so that the sealability based on the sponge 270 can be enhanced. Moreover, in this embodiment, the opposing surface 273*a* and the opposing surfaces 274*a* are the surfaces orthogonal to the pulling-out direction of the paper feed cassette 9, so that the holding force based on the holding unit can be utilized for the pressing force of the sponge 270 more efficiently than in the configuration in which the opposing surfaces are inclined to the pulling-out direction.

In the state where the paper feed cassette 9 is held by the holding unit, the positioning protrusions 286 and the corresponding positioning recesses 287 abut in a state where the sponge 270 receives the pressing force, so that any further movement of the paper feed cassette 9 onto the deeper side of the cassette accommodation portion 4*a* is regulated. Accordingly, in accommodating the paper feed cassette 9, the sponge 270 can be prevented from being pushed in unnecessarily strongly and leading to damage or the like.

Incidentally, in the embodiment as above, the sponge 270 is disposed on the opposing surface 273*a* of the upper peripheral edge part 273 as is the first surface. However, this configuration is not restrictive, but the sponge may well be disposed on the side of the opposing surfaces 274*a* of the keeper walls 274 as are the second surface, or on both the opposing surface 273*a* and the opposing surfaces 274*a*. In the case where the sponge is disposed on the side of the opposing surfaces 274*a*, it should desirably be disposed so as not to project onto (interfere with) the side of the apparatus body 1*a* from these opposing surfaces 274*a*. Besides, when the sponge is disposed on both the opposing surface 273*a* and the opposing surfaces 274*a*, the sealability of the gap S can be enhanced more.

Further, in this embodiment, the opposing surface 273*a* and the opposing surfaces 274*a* are the surfaces orthogonal to the pulling-out direction. However, this is not restrictive, but the opposing surfaces may well be inclined surfaces. Besides, the opposing surfaces may be either at the same angle or at different angles relative to the pulling-out direction. Essentially, the opposing surfaces may be respectively at the angles at which the sponge 270 can be held and pressed therebetween in the pulling-out direction of the paper feed cassette 9.

Additionally, this embodiment has exemplified the laser printer 1 of the so-called "letter-S path scheme" having the U-shaped conveyance path 56. However, this is not restrictive, but the advantages of the invention can be attained even in a scheme having any other conveyance path. Here, in the scheme in which the sheet is folded back and conveyed near the gap S between the paper feed cassette 9 and the opening 2*a* as in the foregoing embodiment, the rustlings come out especially from the gap S, and hence, the invention is particularly effective.

The sponge member 70 has been exemplified as the elastic member. However, this is not restrictive, but any other elastic member of rubber, film or the like may well be employed.

Besides, it is also allowed to employ a configuration in which the elastic member is arranged over the whole periphery of the peripheral edge part of the opening 2*a*.

What is claimed is:

1. An image formation apparatus, comprising:

an apparatus body having a shaft and an image forming unit; and a sheet conveyance apparatus including:

a paper feed cassette which is detachably attached to the apparatus body;

a conveyance unit, including a motor, which separates and conveys a sheet from the paper feed cassette to the image forming unit;

a swing member which is swingably supported about the shaft relative to the apparatus body, and whose swing positions are respectively changed in a state where the paper feed cassette is detached from the apparatus body, a state where the paper feed cassette is attached to the apparatus body and where the sheet is not being conveyed, and a state where the paper feed cassette is attached to the apparatus body and where the sheet is being conveyed; and a detection unit which detects the swing position of the swing member based on a detection by a sensor unit and whether the motor is being driven.

2. The image formation apparatus as claimed in claim 1, wherein:

the sheet conveyance apparatus includes a sheet conveyance path provided between the swing member and the paper feed cassette;

the swing member is arranged in opposition to the paper feed cassette;

the swing member includes a protrusive portion disposed so as to protrude onto the sheet conveyance path, the protrusive portion including a distal end part which abuts on the paper feed cassette;

the swing member is swingable about the shaft to take a first attitude, a second attitude, and a third attitude;

the swing member abuts on the paper feed cassette at a first attitude;

the swing member is turned by collision of the conveyed sheet against the protrusive portion to take the second attitude; and at the third attitude, the swing member is turned in an direction opposite to a direction of turning from the first attitude toward the second attitude when the abutment of the protrusive portion is released by the detachment of the paper feed cassette from the apparatus body.

3. The image formation apparatus as claimed in claim 2, wherein the swing member is disposed above the paper feed cassette; and the distal end part of the protrusive portion is borne on the paper feed cassette at the first attitude.

4. The image formation apparatus as claimed in claim 3, wherein the paper feed cassette is provided with a receiver portion that bears the distal end part of the protrusive portion thereon; and at least one of the distal end part of the protrusive portion and the receiver portion is provided with a guiding slope which guides the distal end part to the receiver portion when the paper feed cassette is attached to the apparatus body.

5. The image formation apparatus as claimed in claim 2, wherein the sheet conveyance apparatus includes: an urging portion that urges the swing member in a direction from the second attitude toward the third attitude.

6. The image formation apparatus as claimed in claim 2, wherein the sensor unit is a photoelectric sensor having a pair of light projecting and light receiving elements and whose optical axis is arranged in a direction along an axial direction of the shaft, and a shield portion which is provided in the swing member and which cuts off an optical path of detection light at the first attitude of the swing member and opens the optical path at any other attitude, or which opens the optical path of the detection light at the first attitude of the swing member and cuts off the optical path at any other attitude; and the detection unit includes a second detection unit which detects the driving of the motor the conveyance unit, wherein the driving of the motor is inhibited when the paper feed cassette is in a state where it is detached from the apparatus body.

7. The image formation apparatus as claimed in claim 6, wherein the apparatus body includes a cassette accommodation portion having a ceiling wall; and when the swing member lies at the first attitude, the shield portion has an upper end part that stands erect so as to confront the ceiling wall.

8. The image formation apparatus as claimed in claim 6, wherein the sheet conveyance apparatus further includes: a separation roller which separates the sheets of paper; and the protrusive portion and the shield portion are arranged on the shaft so as to be juxtaposed in an axial direction of the shaft.

9. The image formation apparatus as claimed in claim 8, wherein the protrusive portion of the swing member is protruded to be disposed downstream of a position where the separation roller is disposed, in a conveyance direction of the sheet.

10. The image formation apparatus as claimed in claim 1, wherein the swing member is disposed at a substantially central part in an axial direction of said shaft.

11. The image formation apparatus as claimed in claim 1, wherein the paper feed cassette includes a part of the sheet conveyance path.

12. The image formation apparatus as claimed in claim 1, wherein the swing member includes a protrusive portion disposed to contact the paper feed cassette in a first position and a sheet being conveyed to the image forming unit in a second position.

* * * * *